United States Patent [19]

Gazda

[11] 4,286,661

[45] Sep. 1, 1981

[54] EQUALIZING VALVE FOR USE IN A WELL TOOL STRING

[75] Inventor: Imre I. Gazda, Saginaw, Tex.

[73] Assignee: Otis Engineering Corporation, Dallas, Tex.

[21] Appl. No.: 159,811

[22] Filed: Jun. 16, 1980

Related U.S. Application Data

[60] Continuation-in-part of Ser. No. 40,035, May 17, 1979, abandoned, which is a division of Ser. No. 437, Jan. 2, 1979, abandoned, which is a division of Ser. No. 864,878, Dec. 27, 1977, Pat. No. 4,149,593.

[51] Int. Cl.[3] ..... E21B 23/00; E21B 47/06

[52] U.S. Cl. ..... 166/316; 166/334

[58] Field of Search ..... 166/316, 319, 334, 115, 166/321, 322, 324, 332, 333, 64, 250, 264

[56] References Cited

U.S. PATENT DOCUMENTS

| | | | |
|---|---|---|---|
| 3,051,243 | 8/1962 | Grimmer et al. | 166/332 |
| 3,051,245 | 8/1962 | Andrew et al. | 166/334 |
| 3,141,506 | 7/1964 | Thomas | 166/332 |
| 3,273,649 | 9/1966 | Tamplen | 166/332 |
| 3,581,819 | 6/1971 | Tamplen | 166/332 |
| 3,960,366 | 6/1976 | Abney et al. | 166/334 X |

*Primary Examiner*—Stephen J. Novosad
*Attorney, Agent, or Firm*—H. Mathews Garland

[57] ABSTRACT

A well testing tool system for isolating vertically spaced portions of a well bore and measuring well conditions such as pressure, and temperature. The system includes a wireline supported tool train and a locking sub connectible on a removable lock mandrel for releasably locking the tool train in a well bore. The tool train has a locking probe releasably connectible in the locking sub, a probe mandrel connected with the probe, an equalizing valve and shock absorber, and a gauge for measuring an operating condition in the well. The locking sub permits insertion of the probe at a low force and requires a larger force for withdrawal. The locking sub grips the probe with a force directly proportional to the pressure differential across the locking sub. The equalizing valve and shock absorber provides for pressure equalization across the tool train during handling and absorbs shock to protect the measuring device. Two forms of the valve and shock absorber are spring biased open. Another form is spring biased closed. Each form of the valve and shock absorber is a telescoping assembly having a longitudinally movable spring biased valve member in a housing and a shock absorber spring between the valve member and housing.

13 Claims, 25 Drawing Figures

EQUALIZING VALVE FOR USE IN A WELL TOOL STRING

This application is a continuation-in-part of U.S. application Ser. No. 40,035 filed May 17, 1979, now abandoned, which is a Div. of U.S. application Ser. No. 437 filed Jan. 2, 1979, now abandoned, which is a division of U.S. application Ser. No. 864,878, filed Dec. 27, 1977, now U.S. Pat. 4,149,593 issued Apr. 17, 1979.

This invention relates to well tools and more particularly relates to a device for equalizing pressures in a well bore across a pressure barrier and for absorbing mechanical shock in a tool train including the device.

It is frequently necessary to measure operating conditions in well bores such particularly as those through which petroleum oil and gas are produced. Among these conditions which are frequently measured are pressure, temperature, fluid flow velocity, and the like. In testing the well to determine values for such various conditions it is normally necessary to isolate a lower portion of the well bore below the testing tool in which the well operating condition is to be measured. Several different forms of apparatus and method have been available for isolating the portion of the well bore in which the operating condition is to be measured. One form involves the use of a packer in the well bore to engage the wall of the well bore or tubing or casing in the well bore and supported by a string of tubing which must be handled by a drilling or workover rig which involves substantial expense and time. Other forms of available packers for isolating a portion of the well bore are supported on mechanically operated wirelines or include apparatus which requires support from an electric power line. Each of these latter forms of packers are difficult to operate because of substantial length and very small clearance between the well tubing wall and the packer structure.

One particular use of such a measuring system is in oil fields which have very low or essentially no formation pressure and are to be produced by secondary recovery methods such as water flood in which water is injected into certain wells in the field and forced through the formation toward other producing wells to displace oil to the surface. Studies of such fields must be made to determine the degree of communication, if any, between wells to be employed as injection wells and other wells to be used as producing wells. Such testing includes setting the testing devices in the producing wells and pumping fluids such as water into the injection wells so that pressure determination may be made in the producing wells for evaluating the communication between the wells. Electric line set packers have been used in the past to make such measurements. Such packers generally require a different size for each size of well bore and additionally had no pressure equalizing system. Under such circumstances a sufficient pressure in the well bore below the testing system would blow the packer up the bore when released.

In well tool systems particularly of the wireline supported type where a testing tool is releasably lockable in a well bore, the tool is inserted and removed under conditions which require pressure equalization between the bore through the tool and the well around the tool. Also shock forces are encountered which can be damaging to the measuring system used. It is therefore desirable to have a tool which can function as an equalizing valve and as a shock absorber in a tool train including the testing tool. No such combination devices are presently known to be available.

It is a principal object of the invention to provide a well tool system which includes shock absorbing means to protect the measuring devices in the system.

It is another object of the invention to provide valves for equalizing the pressure across a well tool system when installing and removing the system.

It is another object of the invention to provide devices of the character described which are normally spring biased open.

It is another object of the invention to provide another form of the device of the invention which is spring biased closed.

It is another object of the invention to provide a device of the character described in which the equalizing valve may be opened and closed against flow.

It is another object of the invention to provide an equalizing valve and shock absorber for a well system, the valve remaining open when running the well system in a well bore and during the stabbing of a probe in this system into a locking sub.

In accordance with the invention there is provided an equalizing valve and shock absorber for equalizing the pressure across a tool train system during insertion and withdrawal of the system and to absorb shock for protecting a testing device connected in the system. The equalizing valve and shock absorber are provided with a longitudinal continuous flow passage for communicating well operating conditions such as pressure, flow rate, and temperature upwardly to a measuring device connected with the tool. The equalizing valve and shock absorber is a telescoping device adapted to open for flow through the device when extended and closed when telescoped together. One form of the device has spring means for holding the device open and reopening the device for equalizing pressure when extended by a pulling force. Another form of the device includes a spring for biasing the device closed permitting the valve to be opened and reclosed against fluid flow in a well bore. The equalizing valve and shock absorber also includes spring means for absoring shock. The shock absorbing spring means is arranged to absorb force when extended upon withdrawal and to absorb force when the equalizing valve and shock absorber are telescoped together during withdrawal as a result of a reaction force on the tool responsive to withdrawal.

The foregoing objects and advantages will be better understood from the following detailed description of a preferred embodiment of the invention taken in conjunction with the accompanying drawings wherein:

FIG. 1 is a longitudinal schematic view partially in section and partially in elevation of a well testing system locked at a landing nipple in the tubing string of a well;

FIGS. 2A, 2B, 2C, 2D, and 2E, taken together, form a longitudinal view in section and elevation of the equalizing valve and shock absorber of the invention, the adjustable mandrel, the probe, the locking sub, and the locking mandrel of the testing system;

Figure 1:
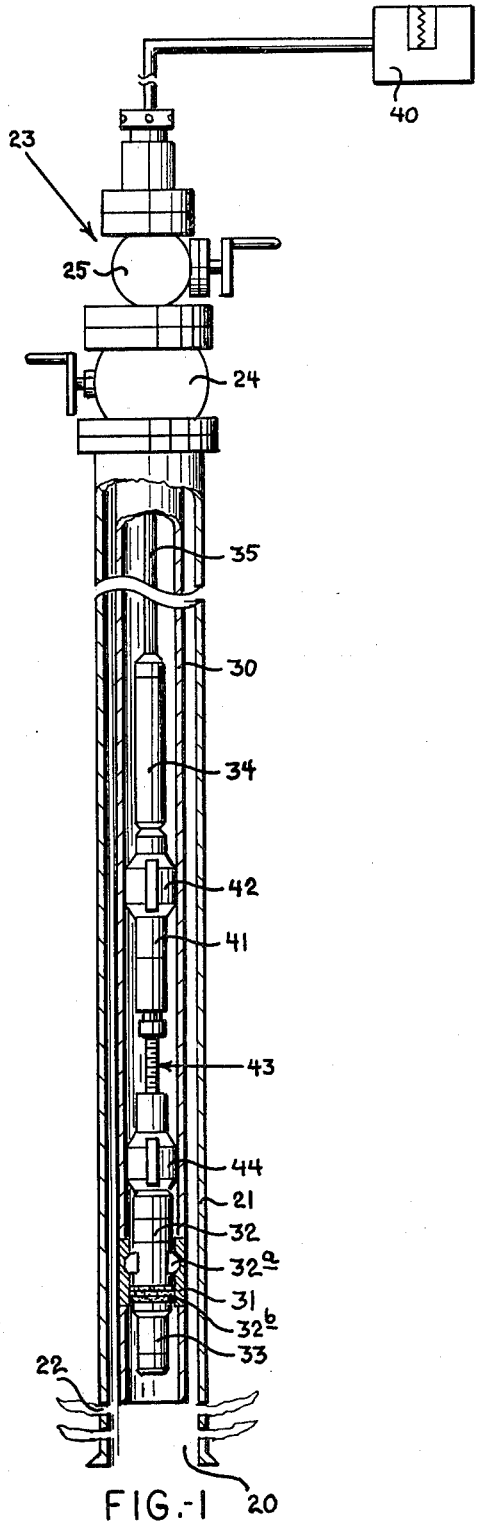

Referring to FIG. 1 of the drawings, a well 20 is shown having a casing 21 perforated at 22 to permit formation fluids to flow into the well through the casing. The casing extends to a wellhead 23 including valves 24 and 25 and supporting a string of tubing 30 extending downwardly in the well bore to a depth in the vicinity of the perforations 22. The tubing string includes a landing nipple 31 in which a lock mandrel 32 is releasably locked. A locking sub 33 is secured on the lower end of the lock mandrel 32. A transducer-type subsurface gauge 34 is supported from a wireline 35 which is preferably an electrical conducting line connected through the wellhead to a recorder 40 at the surface for recording measurements sensed by the gauge. One form of an equalizing valve and shock absorber 41 in accordance with the invention is connected by a coupling 42 to the gauge 34. An adjustable probe 43 is supported from the equalizing valve and shock absorber 41 and connected through a support assembly 44 adapted to land on the upper end of the lock mandrel 32. A locking probe, not shown in FIG. 1, is supported from the lower end of the adjustable probe 43 and releasably locked within the locking sub 33.

Normally a well completion such as illustrated in FIG. 1 includes the installation of the tubing string 30 with one or more landing nipples 31 included along the length of the tubing string for the subsequent installation of a variety of tools which may be required in the operation of the well. The landin nipple has an internal locking profile which is compatible with the locking dogs on the lock mandrel 32. Typically the lock mandrel 32 may be a Type X Otis Engineering Corporation locking mandrel as illustrated and described at page 3958 of the 1974–75 edition of *The Composite Catalog of Oil Field Equipment and Services,* published by World Oil, Houston, TX. The lock mandrel 32 includes expandible locking dogs 32*a* and packing 32*b* as shown in greater detail in FIG. 2D. Other forms of lock mandrels may be employed as required by the particular landing nipple 31 included in the tubing string 30. Since the locking subs 33 may be installed on a variety of locking mandrels, the gauge 34 along with the valve and the shock absorber 41 and the probe assembly supported from the valve and shock absorber may be used in a variety of wells having different tubing size and different landing nipples. Thus, the available testing equipment to service a variety of wells is minimized.

Briefly, in the operation of the system a well originally equipped with the tubing string 30 and the landing nipple 31 is provided in a first step with the locking mandrel 32 on which the locking sub 33 of the invention has been secured. In a subsequent step a tool train including the gauge 34, the equalizing valve and shock absorber 41 of the invention, and the probe assembly 43 is supported on the wireline 35 which is lowered through the wellhead 23 into the tubing string 30 until the probe assembly is inserted into and locked in the locking sub 33. The force required to insert the probe into the locking sub is minimal. During the lowering of the tool train and the insertion of the probe into the locking sub the equalizing valve 41 of the tool of the invention remains open so that the probe may be inserted into sealed relationship in the locking sub. The shock absorbing feature of the equalizing valve and shock absorber of the invention protects the gauge 34 during installation and during pulling of the tool train. The substantially larger force required to pull the locking probe from the locking sub enables the well operator to determine if the tool train is properly locked in operating position. After being properly locked the desired measurements are taken by the gauge 34 and communicated through the cable to the recorder 40 at the surface. While in operation high pressures within the well bore below the locking sub 33 serve only to increase the holding effect of the sub on the locking probe of the tool train. After the tests are completed upward force on the cable 35 releases the tool train from the locking sub. During removal of the tool train the equalizing valve and shock absorber function. Subsequently, if desired, the locking mandrel 32 with the locking sub 33 may be retrieved from the well bore in a separate operation.

Figure 2A:
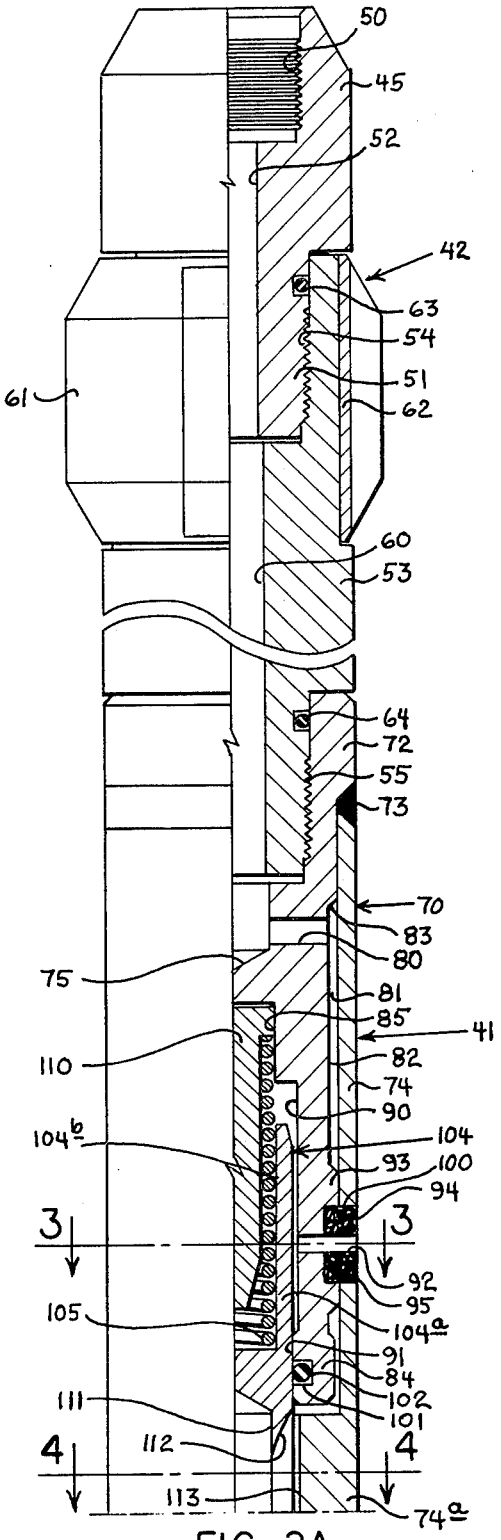
Figure 2B:
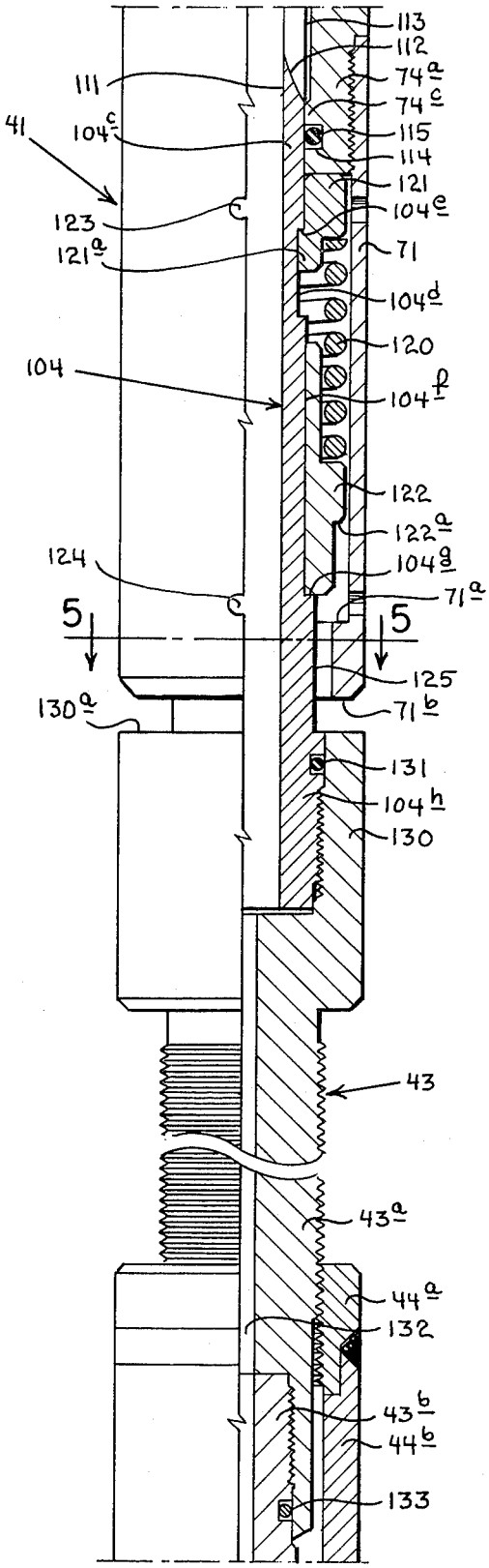

Specific details of the construction of the equalizing valve and shock absorber 41 of the invention and the coupling 42 are illustrated in FIGS. 2A and 2B. Referring to FIG. 2A the coupling 42 includes an upper connector 45 having internally threaded upper end portion 50 and a reduced externally threaded lower end portion 51. The connector has a longitudinal bore 52. The connector 45 is threaded into a central section 53 having an upper end portion internally threaded at 54 and an externally threaded lower end portion 55. The central connector 53 has a longitudinal bore 60 communicating with the bore 52 of the upper connector. An enlarged sleeve 61 having circumferentially spaced longitudinal slots 62 is mounted on the connector 53. A ring seal 63 in an external annular recess of the reduced lower end portion 51 of the upper connector seals between the upper connector and the central connector 53. The externally threaded lower end portion 55 of the central connector is secured into the upper end of the equalizing valve and shock absorber. A ring seal 64 in an external annular recess of the connector 53 seals between the coupling 42 and the equalizing valve and shock absorber.

Figure 3:
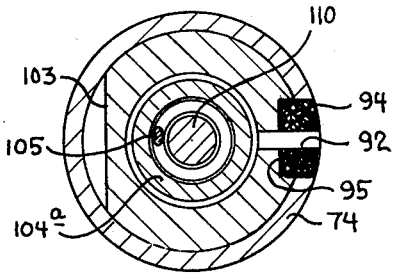
FIG. 3 is a view in section of the equalizing valve and shock absorber taken along the line 3—3 of FIG. 2A.
Figure 4:
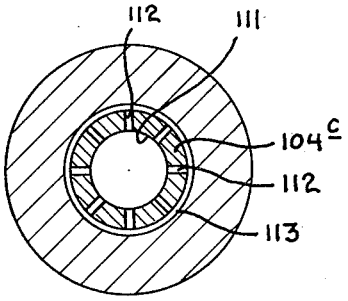
FIG. 4 is a view of section of the equalizing valve and shock absorber taken along line 4—4 of FIG. 2A.
Figure 5:
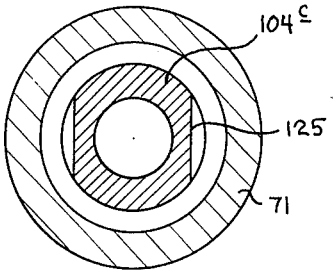
FIG. 5 is a view in section of a lower end portion of the equalizing valve and shock absorber taken along the line 5—5 of FIG. 2B.

The equalizing valve and shock absorber 41 of the invention is a telescoping device which utilizes various relative longitudinal positions of the telescoping parts for performing valving and shock absorbing functions. The device 41 has an outer body formed by a crossover head 70 and a sleeve 71. The crossover head includes a valve guide and manifold member 72 secured as by welding at 73 with a housing member 74 having an externally threaded reduced lower end portion **74*a* which is secured into the upper end portion of the housing sleeve 71. The upper end portion of the member 72 is internally threaded for securing with the lower threaded end portion of the coupling 42 as shown in FIG. 2A. The upper end of the member 72 has an upwardly opening blind bore 75 which opens upwardly into the bore 60 in the coupling 42 and communicates laterally with a plurality of circumferentially spaced radial ports 80 which open at outer ends into an annular chamber 81 defined between the inner wall surface of the sleeve 74 and a longitudinal reduced outer wall portion 82 along the member 72. The reduced outer surface portion 82 of the member 72 extends from a tapered shoulder 83 downwardly to a lower end external flange portion 84 of the member 72 which is larger in diameter than the surface portion 82 but sufficiently smaller than the inner wall surface of the sleeve 74 to provide an annular communication path within the sleeve 74 around the lower end portion of the member 72 into the annular space 81 between the sleeve 74 and the member 72. The member 72 has a downwardly opening graduated bore formed by an upper end section 85, a larger intermediate section 90, and a slightly reduced lower end section 91. The bore portion 90 communicates through the side wall of the member 72 and the sleeve 74 along a single side port 92 as illustrated in FIGS. 2A and 3. The port 92 extends through an externally enlarged wall portion 93 of the member 72 and an annular or ring-shaped weld 94 which connects the sleeve 74 and the member 72 together at the enlarged portion 93 of the member 72. This unique structure for connecting the pieces together and providing the lateral port includes an outwardly opening circular recess 95 formed in the outer wall of the enlarged portion 93 of the member 72 and a circular opening 100 in the sleeve 74. In securing the member 72 into the sleeve 74 the member 72 is properly aligned in the sleeve with the recess 95 of the member 72 aligned with the hole 100 of the sleeve 74 after which the spaced defined by the recess 95 and the hole 100 is filled with the weld 94 and thereafter drilled providing the port 92 extending all the way from the outside of the unit into the bore portion 90 of the member 72. The lower flanged end portion 84 of the member 72 has an internal annular recess 101 which contains an O-ring seal 102 for sealing with the valve member of the device 41. As shown in FIG. 3 the opposite side of the enlarged annular portion 93 of the member 72 is provided with a flat surface 103 which defines with an arcuate portion of the inner wall of the sleeve 74 a longitudinal passage along the member 72 past the enlargement 93 so that fluid flow and pressure may be communicated along the member 72 within the annular space 81 past the enlargement 93**.

Referring to FIGS. 2A, 2B, 3, 4, and 5, a valve and mandrel member 104 is telescopically engaged in the crossover head 70 and housing sleeve 74 for performing both the valving and shock absorbing functions of the device 41. The member 104 has an upper end portion **104*a* which is slidable within the bore portion 90 of the member 72 and is provided with an upwardly opening blind bore 104*b* which houses a portion of a valve spring 105 for biasing the valve-mandrel member downwardly toward a valve open position. The spring 105 is confined between the bottom face of the bore 104*b* at the bottom end of the spring and an external annular flange on a spring guide 110 telescoped downwardly into the spring 105. The upper end of the spring guide 110 engages the upper end of the bore 85 in the member 72. The sole function of the spring guide is to maintain the alignment of the spring as the spring is compressed and expands during the operation of the device 41. The ring seal 102 as shown in FIG. 2A seals around the upper end portion of the valve-mandrel member 104 within the lower flanged end 84 of the crossover head member 72. The upper end portion 104*a* of the valve-mandrel member is smaller in diameter than the bore portion 90 of the member 72 to provide an annular space around the valve member upper end portion for free communication to the side port 92 so that as the valve-mandrel member reciprocates during operation of the device 41 fluid may freely flow into and out of the bore portions 85 and 90 of the member 72. It will be recognized that without the bleed port 92 any fluid confined in the bore portions 85 and 90 would interfere with the operation of the unit. As seen in FIGS. 2A and 2B, the valve-mandrel member 104 has a downwardly opening blind bore 111 which extends throughout the length of a tubular portion 104*c* of the valve-mandrel member 104. The tubular portion 104*c* of the member 104 has a plurality of circumferentially spaced longitudinal arcuate-shaped slots 112 opening into the bore 111. The sleeve 74 is increased in wall thickness along a portion 74*a* which has a longitudinal bore portion 74*b* slightly larger in diameter than the valve-mandrel member section 104*c* defining an annular flow passage 113 around the valve member within the sleeve portion 74*a* generally along the slots 112. As shown in FIG. 2B the sleeve 74 is increased in thickness providing an internal annular flange along a lower end portion 74c which fits tightly around the valve-mandrel section 104c and is provided with an internal annular recess 114 containing a ring seal 115 for sealing between the sleeve 74 and the valve-mandrel member 104. As discussed in more detail hereinafter, the longitudinal position of the slots 112 relative to the ring seal 115 as the valve-mandrel member 104 telescopes during operation of the device 41 determines whether the valve portion of the device 41** is open or closed.

Referring to FIG. 2B, a shock absorber spring 120 is disposed around the valve-mandrel section 104c within the sleeve 71 confined between an upper split ring type spring stop 121 and a lower sleeve type spring stop 122. The upper stop 121 comprises two half ring-shaped segments fitted around the tubular portion 104c of the valve-mandrel. The member section 104c has a reduced portion 104d defining an external annular recess in which an internal flange portion 121a of the split ring segments is slidably engaged. A downwardly facing stop shoulder 104e at the upper end of the recess along the portion 104d limits the upward movement of the upper spring guide 121. The lower sleeve type spring guide 122 slides along a slightly enlarged portion 104f of the valve-mandrel section 104c above an upwardly facing lower stop shoulder 104g which limits downward movement of the lower spring stop 122 on the valve-mandrel. The sleeve 71 has a set of circumferentially spaced upper side ports 123 and similar lower ports 124. Below the shoulder 104g the valve-mandrel section 104c is provided with flat surfaces 125 on opposite sides of the valve-mandrel section for engagement by a wrench or other tool used to assembly and disassemble the device 41. The lower end of the valve-mandrel section 104c is enlarged and externally threaded at 104h for engagement in the upper end of the probe 43 which has an enlarged internally threaded upper end portion 130. A ring seal 131 in an external annular recess of the lower end portion of the valve-mandrel 104 seals between the valve-mandrel and the end portion 130 of the probe to prevent leakage between the two members as the desired data such as pressure must be communicated upwardly through the probe and the valve-mandrel members.

Figure 2C:
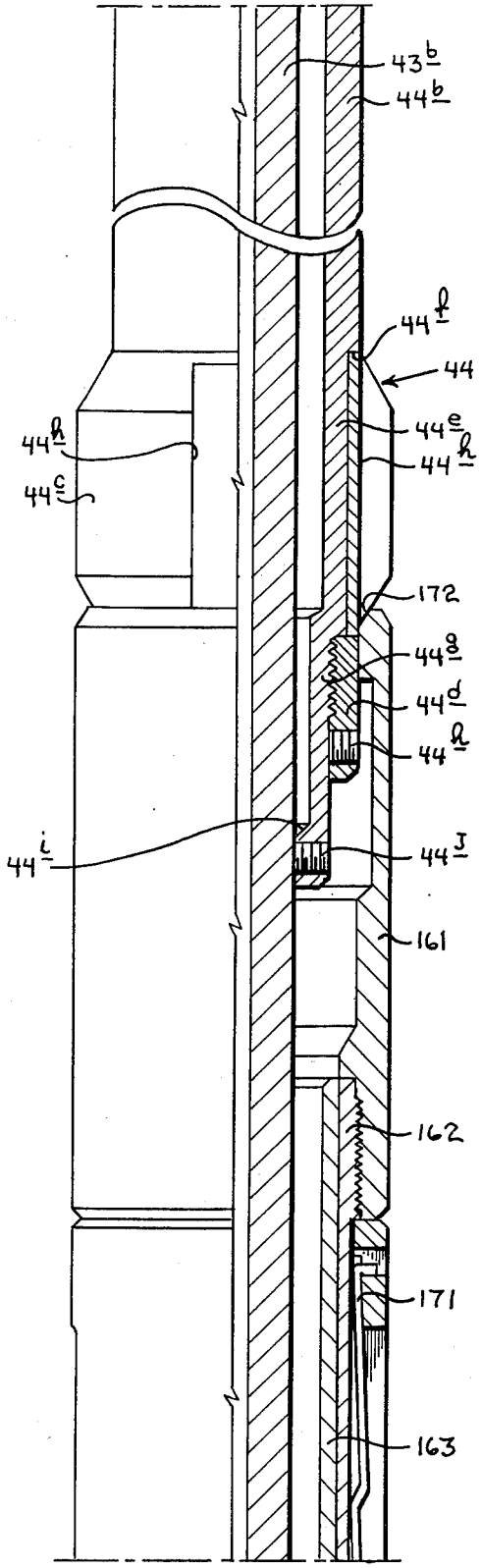
Figure 2D:
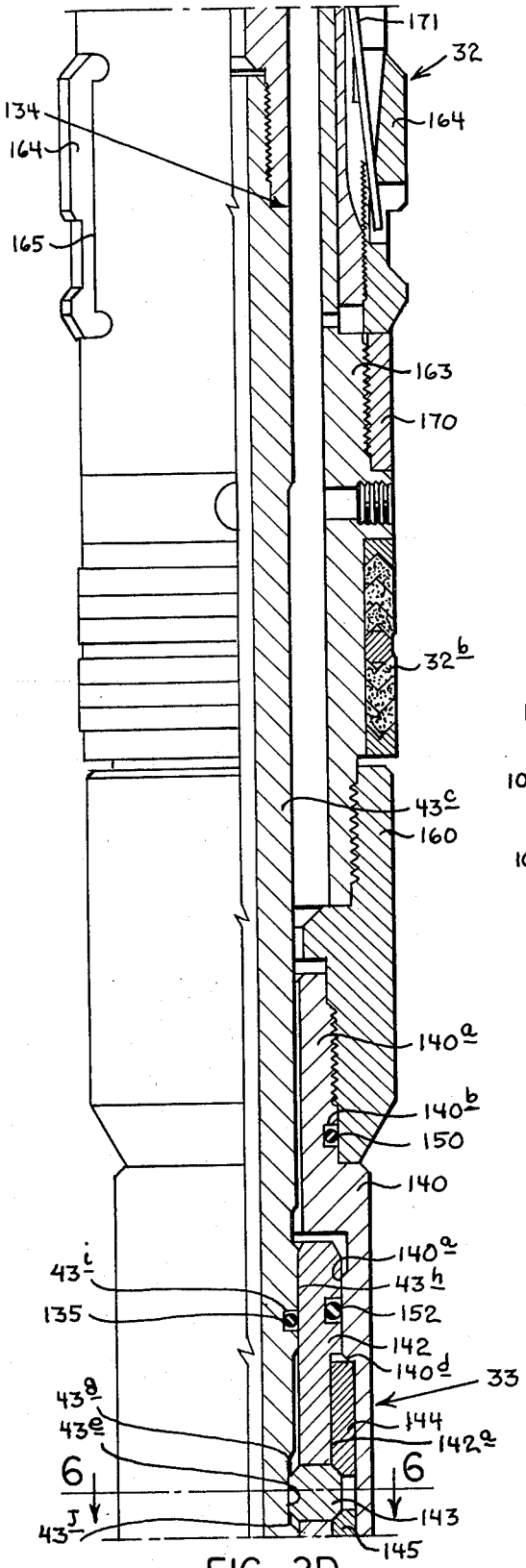

Referring to FIGS. 2B, 2C, 2D, and 2E, the probe assembly 43 has an upper externally threaded section 43a, a long central section 43b, and a lower locking section 43c. Each of the sections of the probe assembly is tubular in shape defining a flow passage 132 which extends the full length of the assembly to communicate fluid pressure and the like from below the probe upwardly into the equalizing valve and shock absorber device 41. The several sections of the probe assembly are secured together by threaded connections as seen in FIGS. 2B and 2D. A ring seal 133 in an external annular recess of the probe section 43b seals between the probe section 43b and the section 43a. The threaded connection between the probe assembly 43b and 43c as shown in FIG. 2D is welded at 134 to provide a permanent fluid tight connection. As explained in greater detail hereinafter, the threaded section 43a permits the probe assembly to be accommodated to different lock mandrels by adjustment of the longitudinal position of the lower locking end section of the probe assembly.

Referring to FIGS. 2B and 2C the landing sleeve assembly 44 which supports the tool train on the locking mandrel 32 is connected with the threaded probe section 43a so that the relative position of the probe assembly 43 is adjustable in the landing sleeve assembly. The landing sleeve assembly includes an internally threaded ring-shaped head member 44a welded into an elongated sleeve 44b, a no-go type support ring 44c mounted on the sleeve 44b, and a retainer ring 44d for holding the ring 44c on the sleeve. The ring 44c is on a reduced portion 44e of the sleeve 44b providing a downwardly facing stop shoulder 44f holding the ring 44c against upward movement on the sleeve. The retainer ring 44d is threaded on a still further reduced section 44g of the sleeve 44b. The ring 44d has a threaded hole 44h for a set screw, not shown, for locking the ring 44d in place on the reduced sleeve section 44g. The sleeve 44b along the lower end portion of the sleeve has an internal flange 44i forming a close fit with the probe assembly section 43b to cooperate with the threaded connection between the support sleeve assembly 44 and the probe assembly at the ring 44a for properly maintaining the alignment of the probe assembly through the landing sleeve assembly. The flanged section 44i of the sleeve 44b has a threaded hole 44j for a set screw for locking the sleeve 44b with the probe assembly section 43b at the flange 44i. The no-go ring 44c has circumferentially spaced longitudinal slots 44k which permit fluid flow along the ring 44c as the tool string is raised and lowered in the tubing string of a well bore.

Figure 2E:
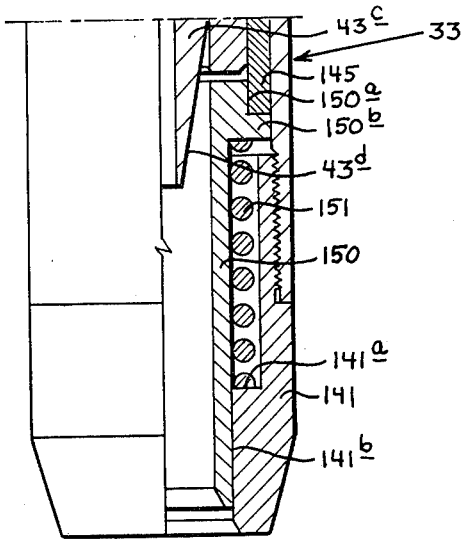

Referring to FIGS. 2D and 2E, the lower end locking section 43c of the probe assembly is configured for releasable locking in the locking sub 33 responsive to a low downward force on the probe assembly and releasable upon application of a substantially larger upward force on the probe assembly. The probe assembly section 43c has a tapered lower end portion defined by a downwardly and inwardly convergent entry cam surface 43d which slopes at a very low angle such as about 10 degrees with the longitudinal axis of the probe section so that the cam surface will exert a substantial lateral force perpendicular to the longitudinal axis of the probe section responsive to a relatively low downward force on the probe. For example, in one prototype a downward force of 15 pounds on the probe applies a lateral force of 86 pounds for operating the locking sub 33. Above the entry cam surface 43d as shown in FIG. 2D the probe section 43C has an external annular locking recess 43e defined between a lower cam surface 43f and an upper cam surface 43g. The lower cam surface 43f is the release cam surface of the probe and the angle of the cam surface is critical to the operation of the probe concerning the force required for pulling the probe upwardly out of the locking sub 33, for example. As contrasted with a low entry force for the probe of 15 pounds, it is preferred that the upward release force on the probe be in the neighborhood of 200 pounds. Above the locking recess 43e, the probe section 43c has an external annular boss 43h provided with an external annular recess 43i which contains a ring seal 135 for sealing with the bore through the locking sub 33 so that fluid is limited to the bore through the probe assembly when the probe assembly is properly seated and locked with the locking sub.

Figure 9:
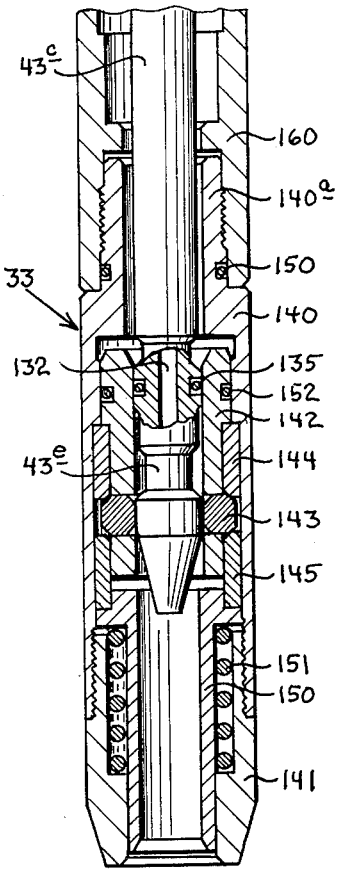
FIG. 9 is a fragmentary view in section of the lower portion of the probe and the locking sub with the lugs of the locking sub expanded as when the probe is being inserted into the locking sub and when the probe is released from and being withdrawn from the sub.

Referring to FIGS. 2D, 2E, and 9, the locking sub 33 includes a tubular housing 140, a bottom sub 141, an annular piston 142, a plurality of circumferentially spaced locking lugs 143, upper and lower locking cam sleeves 144 and 145, a tubular operator member 150, and an operator member spring 151. As shown in FIG. 2D the housing 140 has a reduced threaded upper end portion 140*a* which engages the lower end of the lock mandrel 32 for supporting the locking sub 33 from the lock mandrel 32. A ring seal 150 in an external annular recess 104*b* of the housing 140 seals between the locking sub housing and the housing of the lock mandrel. The piston 142 firs within an enlarged bore portion of the housing 140 which has an internal annular seal surface 140*a* which permits a sliding seal with the upper external wall surface of the piston 142. A ring seal 152 in an external annular recess along the upper end portion of the piston 142 provides a fluid tight sliding seal between the piston and the seal surface 140*a* of the housing. The upper cam sleeve 144 forms a sliding fit with a reduced portion 142*a* of the piston 142. The upper end edge of the sleeve 144 engages a downwardly facing internal stop shoulder 140*d* which prevents upward movement of the sleeve 144 in the housing. The lower cam sleeve 145 also forms a sliding fit with the reduced portion 142*a* of the piston 142 below the locking lugs 143. The lower sleeve 145 also is slidable in the housing 140 and is seated along a lower end portion in an external annular recess 150*a* against an upper face of an external annular flange 150*b* of the operator member 150 so that the sleeve 145 and the operator member 150 move upwardly and downwardly together during the locking and releasing of the probe assembly in the locking sub. The spring 151 is confined between the bottom face of the flange 150*b* at the upper end of the spring and an internal annular stop shoulder 141*a* within the bottom sub 141 at the bottom end of the spring so that the spring biases the operator member 150 upwardly. The lower end portion of the operator member 150 is slidable in a reduced lower end portion 141*b* of the bottom sub 141.

Figure 6:
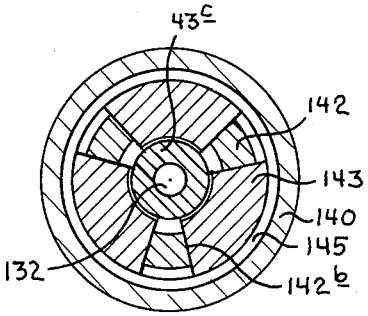
FIG. 6 is a view in section of the probe and locking sub taken along the line 6—6 of FIG. 2D.

Referring to FIGS. 2D and 6, the locking lugs 143 are each a 90 degree arcuate segment member slidably positioned in a window 142*b* of the annular piston 142. As seen in FIG. 6 three of the 90 degree locking lug segments are provided disposed circumferentially through three windows 142*b* provided in the annular piston. The side walls of the lugs are inwardly convergent as are the side walls of the windows in which the lugs slide. The top and bottom faces of the lugs are parallel with each other and perpendicular to the vertical axis of the lugs. The top and bottom faces of the windows 142*b* as evident in FIG. 2D are parallel with each other and perpendicular to the longitudinal axis of the piston 142. The lugs are tightly but slidably fitted in the windows whereby the lugs may move inwardly and outwardly laterally or radially but may not move vertically or longitudinally relative to the piston 142. The lugs and the piston must move vertically together.

Figure 10:
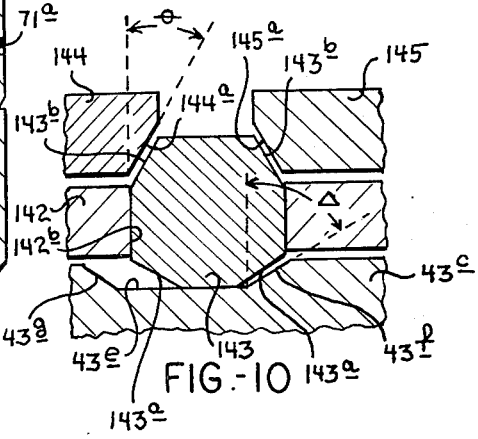
FIG. 10 is an enlarged fragmentary view in section showing one of the locking lugs of the locking sub along with the probe and the annular piston and cam sleeves of the locking sub illustrating the angles between the cam surfaces on the locking lug and on the upper cam sleeve of the locking sub and on the release surface of the probe.

FIG. 10 shows a single one of the lugs 143 with fragments of the supporting annular piston 142, the upper and lower cam sleeves 144 and 145 and the locking section 43*c* of the probe assembly in the vicinity of the locking recess 43*e* of the probe section. It will be recognized that FIG. 10 for purposes of discussion and illustration has been rotated 90 degrees counterclockwise from the actual operating position of the parts illustrated which would normally be in a vertical well position as shown in FIGS. 2D and 2E as well as FIG. 9. Each of the locking lugs 143 has internal tapered cam surfaces 143*a* which are circular segments geometrically being a segment of a conical surface sloping toward each other. Similarly, each of the lugs 143 has external arcuate cam surfaces 143*b* which slope outwardly and toward each other on the lug. Similarly, each of the upper and lower cam sleeves 144 and 145 is provided with a sloping internal annular cam surface. The sleeve 144 has a cam surface 144*a* which is engageable with the upper locking lug cam surface 144*b*. The lower cam sleeve 145 has a cam surface 145*a* engageable with the lower locking lug cam surface 143*b*. Generally, internal lug cam surfaces 143*a* are aligned at the same angles which correspond with the angles of the probe cam surfaces 43*f* and 43*g*. Also, the outer lug cam surfaces 143*b* are aligned at the same angles which correspond with the angles of the sleeve cam surfaces 144*a* and 145*a*. The relationship between the angle $\Delta$ and the angle $\Theta$ must allow removal of the probe from a locked position within the locking lugs which means that when the probe is pulled upwardly, to the left in FIG. 10, the cam surface 43*f* on the probe must force the lugs 43 outwardly with the lug cam surface 143*b* sliding outwardly and downwardly along the sleeve cam surface 144*a*. The angle $\Delta$ must exceed the angle $\Theta$ by a predetermined value, taking into consideration the friction angle of the materials involved, to avoid jamming of the probe within the locking lugs such that it will not cam the lugs outwardly and thus cannot be withdrawn from the locking sub. The angle of friction between lubricated contacting hard steel surfaces is, for example, about 10–12 degrees. The angles $\Theta$ and $\Delta$ as represented in FIG. 10 are determined as follows. The angle $\Theta$ is equal to the value of a preselected angle minus a friction angle. The angle $\Delta$ is equal to a preselected angle plus the friction angle. The values of the preselected angles are engineering considerations based upon the forces desired for insertion and removal of the probe. Typically it has been found that the angle $\Delta$ should exceed the angle $\Theta$ by approximately 30 degrees. In one operable prototype the angle of the inner lug cam surfaces 143*a* measured in the same manner as the angle $\Delta$ was set at 55 degrees while the angle of the outer lug cam surfaces 143*b* measured in the manner of the angle $\Theta$ was set at 25 degrees to produce a probe withdrawal force required for release of the probe at approximately 200 pounds. It will be apparent that while the angle $\Delta$ may not be decreased to a value below a predetermined value which exceeds the angle $\Theta$ by the required differential, any increase of the angle $\Delta$ in excess of the necessary minimum will reduce the magnitude of the force required to pull the probe out of the locking sub. Other factors to be described also affect the value of the force required for release of the probe. Other factors which affect the force required to insert and withdraw the probe include the force required to compress the spring 151. It will be recognized that since the cam sleeve 144 cannot move upwardly and for the probe to enter or withdraw from the locking sub, the lugs 143 must move radially outwardly and the only way that the lugs can move outwardly is for the lower cam sleeve 145 to move downwardly against the spring 151. Thus, when the probe is entering the locking sub and when the probe is being withdrawn from the sub the cam surfaces on the probe force the locking lugs outwardly causing the upper outer cam surfaces 143*b* on the lugs to slide outwardly and downwardly along the cam surface 144*a* of the upper cam sleeve 144. The outward downward movement of the lugs carries the annular piston 142 downwardly and forces the lower cam sleeve 145 downwardly moving the operating member 150 downwardly compressing the spring 151. Opposing the upward force of the spring 151, during the insertion of the probe a downward force on the probe cam surface 43*g* against the locking lug upper cam surfaces 143*a* has a downward component which is transmitted through the lugs 143 to compress the sleeve 145 downwardly and at the same time produces a radial force expanding the lugs 143 against the upper sleeve cam surface 143*a* and as the lugs move outwardly that also tends to depress the cam sleeve 145. A somewhat different condition exists upon withdrawal of the probe when the upward component of the force on the lugs 143 applied to the lower inner cam surfaces 143*a* is resisted by the upper cam sleeve 144 while the horizontal component of the forces applied to the lugs 143 again expands the lugs forcing them outwardly and downwardly along the cam surface 144*a* again depressing the cam sleeve 145.

A particularly important feature of the locking sub 33 is that as the fluid pressure differential across the annular piston 142 of the sub increases with the higher pressure existing within the tubing string below the seal 32*b*, the locking sub grips the probe more securely preventing the higher pressure from blowing the probe upwardly out of the locking sub. The annular piston 142 has limited longitudinal upward movement within the housing 140. The locking lugs 143 are fitted for radial movement only within the windows of the annular piston. The upper cam sleeve 144 cannot move upwardly due to the stop shoulder 140*d*. Thus, a higher fluid pressure applied across the annular area defined between the line of sealing of the ring seal 135 with the inner wall of the piston 142 and the line of sealing of the ring seal 152 with the seal surface 140*a* of the housing 140 urges the annular piston 142 upwardly. The upward force tends to carry the locking lugs 143 upwardly with the annular piston 142 so that the upper outer cam surfaces 143*b* on the lugs are urged against the lower cam surface 144*a* on the cam sleeve 144 forcing the lugs inwardly more tightly against the probe section 143*c* in the locking recess 43*e* of the probe section. As the pressure differential across the annular piston 142 increases the grip of the lugs on the probe increases.

The locking sub 33 is secured on the lock mandrel 32 by a coupling 160 which threads on the lock mandrel below the packing assembly 32*d*. As previously mentioned the lock mandrel 32 is a standard available Otis Engineering Corporation Type X Locking Mandrel. The mandrel has an upper tubular fishing neck 161 secured along a lower end portion with a slidable expander mandrel 162 which is mounted on a body mandrel 163 as shown in FIGS. 2C and 2D. The body mandrel 163 connects with the coupling 160 and supports the packing 32*b*. A plurality of radially expandible locking dogs 164 are mounted in windows 165 of a locking dog retainer sleeve 170 mounted on the body mandrel. Each of the locking dogs is biased outwardly by a spring 171. The locking dogs 164 are expanded and locked outwardly by downward movement of the expander mandrel responsive to a downward force on the fishing neck. An upward pull on the fishing neck lifts the expander mandrel to release the locking dogs when the locking mandrel is to be removed from a landing nipple. The upper end of the fishing neck has an internal downwardly and inwardly tapered support shoulder 172 on which the no-go ring 44*c* of the landing sleeve assembly 44 rests when the probe assembly is inserted into and locked with the locking sub 33. A particular benefit of the threaded adjustable section of the probe assembly 43 is the capability of adjusting the distance between the no-go ring 44*c* and the lower locking section of the probe compatible with the distance between the landing shoulder 172 on the fishing neck 161 and the locking lugs 143 in the locking sub 33 connected on the lower end of the lock mandrel.

In a typical prototype the locking sub 33 utilized a 25 degree angle for the outer lug cam surfaces 143*b* as previously discussed, a 55 degree angle for the inner lug cam surfaces 143*a* with corresponding angles on the probe and the cam sleeves along with a spring 151 which applied approximately a 75 pound load on the operator 150. Such a locking sub required a 15 pound downward force on the probe assembly 43 to insert the probe to a locking position and a 200 pound upward force to retrieve the probe. The equalizing valve and shock absorber 41 employed a spring 105 which required a 25 pound force to compress the spring for closing the equalizing valve and utilized a shock absorber spring 120 requiring a 150 pound force for full compression during the shock absorbing function of the device 41.

The first step in the operation of the system in a well fitted with the tubing string 30 and the landing nipple 31 is the connection of the locking sub 33 on the lower end of a lock mandrel 32 in the relationship as shown in detail in FIGS. 2D and 2E, and the landing and locking of the lock mandrel 32 in the landing nipple 31 in the tubing string. This procedure is carried out in the usual standard steps involving the engagement of a wireline handling tool with the fishing neck 161 of the lock mandrel 32. The wireline handling apparatus and the technique of operating the apparatus are well known and comprise no part of the present invention. The particular lock mandrel 32 selected is compatible with the landing nipple 31 in having locking dogs 32*a* which have landing and locking profiles matching the internal profile of the landing nipple. By selection of the proper coupling 160 as shown in FIG. 2D the locking sub is attachable to any desired size and design of lock mandrel.

Figure 7:
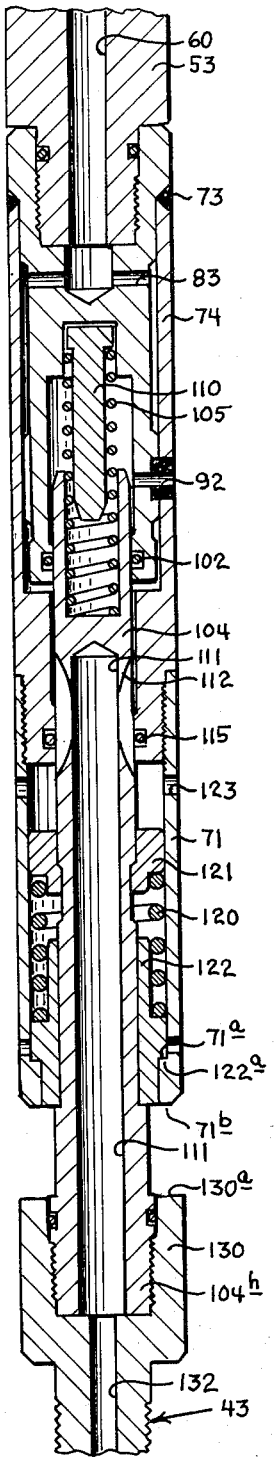
FIG. 7 is a fragmentary longitudinal view in section of the equalizing valve and shock absorber extended with the equalizing valve open during lowering the tool train in a well bore and during the initial step of pulling the train from locked condition from the locking sub.

After the installation of the lock mandrel 32, the tool string including the measuring device 34, the coupling 42, the equalizing valve and shock absorber device of the invention, the probe assembly 43, and the probe assembly landing sleeve 44 are attached together and lowered with the usual wireline apparatus into the well tubing string 30 on the electric wireline 35. In accordance with the invention, during the lowering of the tool string, the equalizing valve and shock absorber 41 extends to open the equalizing valve portion of the device as illustrated in FIG. 7. The weight of the probe assembly 43 along with the associated connected parts including the valve-mandrel 104 of the device 41 coupled with the force of the valve spring 105 telescopes the valve mandrel 104 to a lower end position within the crossover head 70 and sleeve 71 of the unit 41 as illustrated in FIG. 7. The valve-mandrel telescopes downwardly until the stop shoulder 122*a* on the member 122 engages the internal annular stop shoulder 71*a* within the internally flanged lower end portion of the sleeve 71. At the lower end open position of the valve-mandrel bypass communication is provided from the bore 111 radially outwardly through the slots 112 and downwardly within the slots past the lower ring seal 115 into the sleeve 71 below the lower end of the member 74 above the split ring spring retainer 121 and outwardly through the side ports 123. The lower end of the bore 111 communicates with the bore 132 of the probe assembly 43 which extends through the lower end of the probe assembly so that fluid bypass is provided from below the probe assembly through the entire length of the assembly and valve-mandrel member outwardly through the side ports 23 of the device 41 which materially aids in the lowering of the tool string and permits the probe assembly to be stabbed into a sealed locked relationship within the locking sub 33 as shown in FIGS. 2D and 2E. When the valve-mandrel 104 telescopes downwardly, the side port 92 of the device 41 permits inward fluid flow into the chamber around the upper end portion of the member defined by the bores 85 and 90 within the crossover head 70. The equalizing valve and shock absorber device 41 remains open as illustrated in FIG. 7 until the probe assembly is fully inserted into and locked with the locking sub 33 because the spring 105 requires 25 pounds for compression of the spring while the probe assembly locking tip requires only 15 pounds for insertion to the fully locked position represented in FIGS. 2D and 2E. The locking tip of the probe assembly is lowered through the bore of the lock mandrel 32 into the bore of the locking sub 33 within the lugs 143 of the locking sub. The tapered cam surface **43*d* along the lower end portion of the probe engages the inside faces of the lugs 143 camming the lugs outwardly as shown in FIG. 9 to expanded positions which permits the probe to pass downwardly until the lugs 143 are aligned with the locking recess 43*e* on the probe. The outward expansion of the lugs 143 as evident from FIG. 10 causes the lug cam surfaces 143*b* to slide outwardly along the cam surfaces 144*a* and 145*a* of the cam sleeves 144 and 145 respectively. It will be evident that for the lugs to move outwardly between the sleeves 144 and 145 the lower sleeve 145 must move downwardly against the spring 151 since the upper sleeve 144 is limited by the shoulder 140*d* against upward movement. The operator member 150 supporting the sleeve 145 is depressed sufficiently downwardly compressing the spring 151 to allow the full outward expansion of the lugs 143 for the probe locking tip to pass within the lugs until the recess 43*e* on the locking tip is aligned with the lugs. The force of the spring 151 acting upwardly on the operator member 150 lifts the cam sleeve 145 toward the upper sleeve 144 squeezing the lugs 143 back inwardly to the locking positions represented in FIGS. 2D and 10**.

Figure 8:
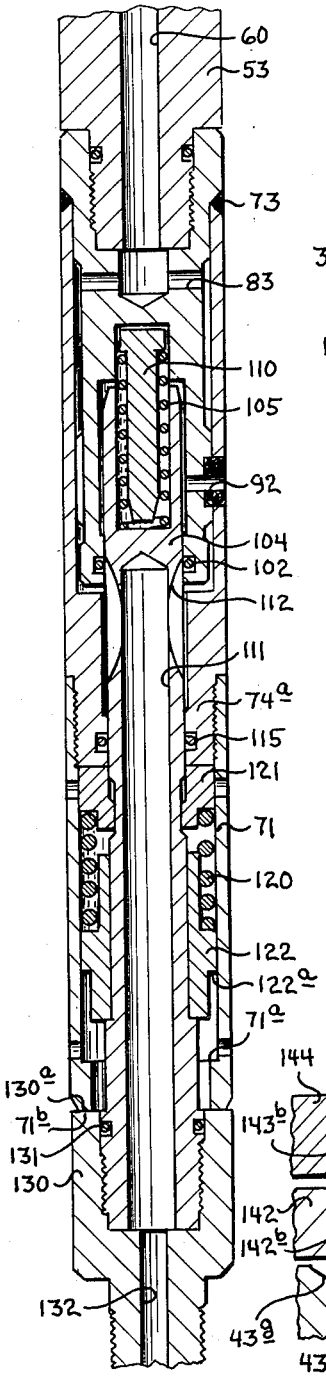
FIG. 8 is a fragmentary longitudinal view in section of the equalizing valve and shock absorber telescoped together as when the tool train initially lands and locks in the locking sub and when the tool train is pulled and released causing a reaction force to compress the device together.

During a normal installation of the system the shock absorbing features of the equalizing valve and shock absorber 41 will not function. If, however, a larger than normal downward force is applied to the system which could occur for example as a reaction to lowering the tool string too fast causing it to strike the lock mandrel at a velocity which would telescope the tools including the gauge 34 and the coupling 42 downwardly, the crossover head 70 along with the sleeve 71 move downwardly while the probe assembly 43 including the valve-mandrel member 104 which is secured with the probe assembly are held against downward movement by the engagement of the landing ring **44*c* on the lock mandrel shoulder 172 as seen in FIG. 2C. The crossover head and sleeve of the device 41 move downwardly until the lower end edge 71*b* of the sleeve engages the upper end edge 130*a* on the head end of the probe assembly section 43*a*. As the crossover head and sleeve move downwardly, the lower end edge of the member 74*a* forces the split ring segments 121 downwardly against the shock absorber spring 120. The split ring segments move downwardly along the recess 104*d* on the valve-mandrel 104 as shown in FIG. 8. The shock absorber spring thus absorbs impact loading to protect the gauge 34** from shock damage.

A principal reason for providing the substantial load requirement for disengaging the probe assembly from the locking sub 33 is to enable the operator of the system to be assured that the probe assembly is properly locked before taking further steps which would place a pressure differential across the system that might blow it back up the well. The substantially larger force such as the 200 pounds previously discussed required to disengage the probe permits the operator to place enough upward load on the wireline which can be measured at the surface to know that the probe is properly locked. When such upward load is applied to the wireline the device 41 will be telescoped to an extended condition which may range from that shown in FIG. 7 to that of FIG. 11 in which the shock absorber spring 120 is compressed upwardly. Of course, if the upward force applied to check the probe is less than that required to compress the shock absorber spring, the system will telescope to the condition of FIG. 7.

After the system is properly landed and locked as described, the desired measurements may be made with the gauge 34. For example, if pressure testing of a well to be used as a producing well in a secondary recovery operation is the objective the pressure in the formation is raised at the injection well or wells with the measurements then being taken with the system of the invention at the producing well in which the system is installed. The pressure within the well bore is applied upwardly through the bore 132 of the probe assembly 43, through the bore 111 of the equalizing valve and shock absorber 41, outwardly through the radial slots 112 into the annular space 113 between the valve-mandrel 104 and the member 74. The pressure is communicated upwardly in the annular space 113 into the annular space 81 in the crossover head 70 along the flat surface 103 as shown in FIG. 3 and upwardly continuing along the annular space 81 into the side ports 80 to the bore 60 in the coupling 42 through which the pressure is communicated to the gauge 34. Such communication is made possible by the fact that the equalizing valve is closed when the weight of the tool string is placed on the device after completion of the locking of the probe assembly in the locking sub. The weight of the tool string above the device 41 is sufficient to compress the spring 105 returning the equalizing valve and shock absorber to the condition represented in FIGS. 2A and 2B at which the valve slots 112 are longitudinally between the upper ring seal 102 and lower ring seal 115 thereby confining the pressure communication to the annular space 113 from which it is communicated upwardly as described.

As previously discussed in detail in connection with the description of the locking sub 33, a pressure differential across the annular piston 142 of the locking sub urges the piston and the locking lugs 143 upwardly applying a radially inwardly acting force on all of the lugs due to the coaction between the upper cam sleeve surface **144*a* and the upper outer locking lug cam surfaces 143*b***. The greater the pressure differential the more tightly the locking sub grips the probe assembly. Thus, while the probe may be released from the locking sub by a force on the order of about 200 pounds depending upon probe and locking sub design, a well pressure below the locking sub may apply substantially higher pressures across the sub and locked probe without dislodging and forcing the probe upwardly due to the fact that the gripping of the locking sub with the probe increases in direct relation to the increase in the pressure differential across the members.

Figure 11:
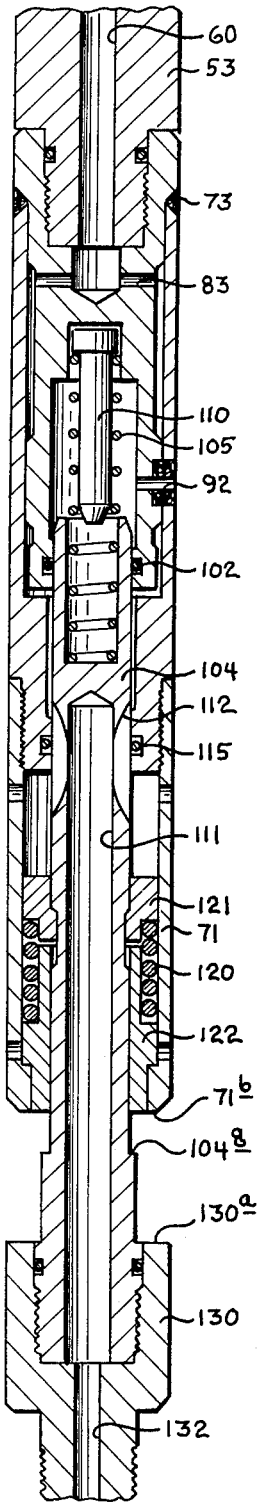
FIG. 11 is a fragmentary longitudinal view in section of the equalizing valve and shock absorber illustrating the operation of the device when pulling upwardly on the tool train such as when checking to see if the train is locked in the well bore and when pulling on the tool train to release the train from the locking sub.

When the desired measurements have been taken by the gauge 34 and recorded if desired by the recording unit 40 at the surface, the system of the invention may be removed from the well bore. An upward force is applied at the wellhead to the wireline 35 which lifts the gauge 34, the coupling 42, and the crossover head 70 and sleeve 71 of the equalizing valve and shock absorber 41. With the probe assembly 42 and the valve-mandrel 104 of the equalizing valve and shock absorber of the invention being held against upward movement due to the locking of the probe assembly with the locking sub 33, the device 41 is telescoped initially to the condition shown in FIG. 7. The sleeve shoulder 71*a* then engages the shoulder 122*a* on the shock absorber operator member 122 lifting the member upwardly compressing the shock absorber spring 120 toward the split ring segments 121 at the upper end of the spring which cannot move upwardly on the member 104 due to engagement with the stop shoulder 104*e*. FIG. 11 represents the relative position of the parts of the device 41 after the shock absorber spring has compressed substantially. The operator member 122 is lifted against the shock absorber spring unitl the upper end edge of the member engages the lower end edge of the split ring segments 121 picking up the valve-mandrel member 104 thereby applying the upward force to the probe assembly 43. When the force exceeds the required value, such as 200 pounds in one form of the device as discussed, the locking end of the lower probe section cams the locking lugs 143 outwardly to the positions shown in FIG. 9 releasing the probe. It will be seen both in FIG. 7 and in FIG. 11 that throughout the pulling of the probe the valve-mandrel 104 is at an open position opening the equalizing valve and thereby communicating the central bore of the probe with the side ports 123 equalizing the pressure across the probe as it is pulled from the sealed locked relationship in the locking sub 33. In applying the upward pulling force to the tool string, after overcoming the locking and frictional resistance to upward movement of the probe, the probe tends to snap upwardly shifting the valve-mandrel member upwardly against both the valve spring 105 and the shock absorber spring 120 until the device 41 telescopes together as shown in FIG. 8 limited by the engagement of the shoulder 130*a* on the upper end of the probe assembly with the downwardly facing shoulder 71*b* on the sleeve 71 of the equalizing valve and shock absorber unit. The energy absorption characteristic of both springs thereby protects the gauge 34 from shock damage due to this reaction force when the probe assembly snaps upwardly. Thereafter, the weight of the probe assembly and connected parts pulls the probe assembly and parts back downwardly to the positions shown in FIG. 7 at which the equalizing valve is open as the tool string is pulled upwardly in the well bore. Throughout the telescoping action of device 41 the side port 92 allows fluid to flow into and out of the bore spaces around the upper end of the valve-mandrel 104. Thus, any fluid in the bore spaces when the valve-mandrel moves upwardly is expelled through the port 92.

Subsequent to the removal of the tool string down through and including the probe assembly 43 from the lock mandrel 32, the lock mandrel with the connected locking sub 33 may be retrieved from the landing nipple 31 using standard wireline apparatus and procedures for engaging the lock mandrel at the fishing neck 161 to release the lock mandrel by pulling upwardly on the fishing neck allowing the keys 164 to contract inwardly. Removal of the lock mandrel 32 restores the well to the original condition.

Another form of equalizing valve and shock absorber 41A embodying the features of the invention is illustrated in FIGS. 12–16 inclusive. The device 41A performs the same equalizing valve and shock absorbing functions as the previously described device 41. In the device 41 the spring arrangement urges the telescoping members of the device in directions to open the equalizing valve features of the device. In contrast, in the device 41A the spring member urges the telescoping members of the device in directions which close the equalizing valve features of the device an additional force to urge the valve closed against fluid flow. Such a feature is desirable in a situation where the tool string including the equalizing valve and shock absorber 41A is landed and locked in a well bore in which liquid is flowing upwardly around the tool string. Under this particular operating condition, the device 41 is difficult to open to allow bypass and reclose against liquid flowing in the well because the spring 105 urges the member 104 and the housing of the device in opposite directions to open the valve, and the force of the spring thus must be opposed in addition to the resistance of fluid flow to reclose the valve. The spring in the alternate form 41A of the device urges the valve housing downardly to a valve closed position thus making the force of the spring available with the weight of the tool string to lower the tool string back downwardly to reclose the valve against fluid flow.

Figure 12:
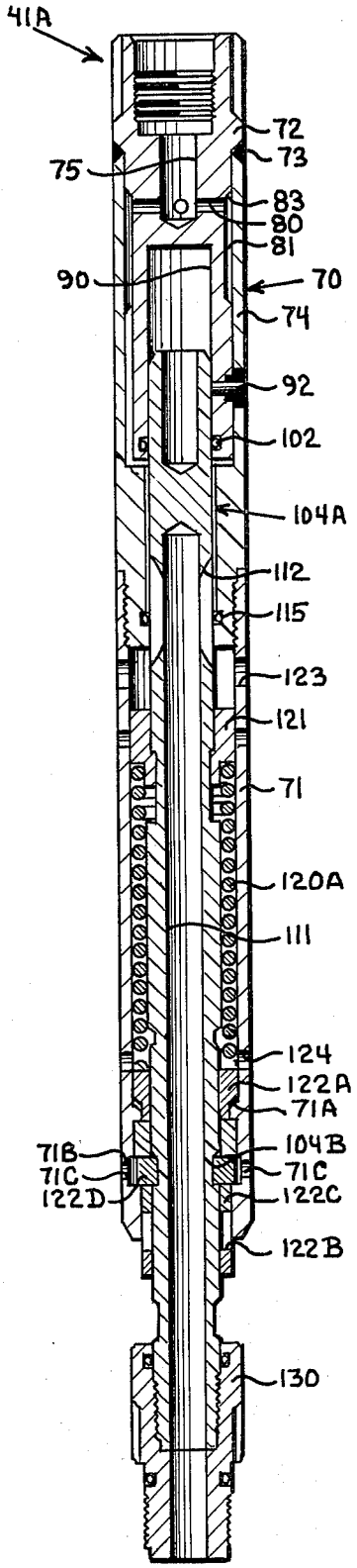
FIG. 12 is a longitudinal view in section of another form of the equalizing valve and shock absorber as the tool is run into a well with the valve device partially open.
Figure 13:
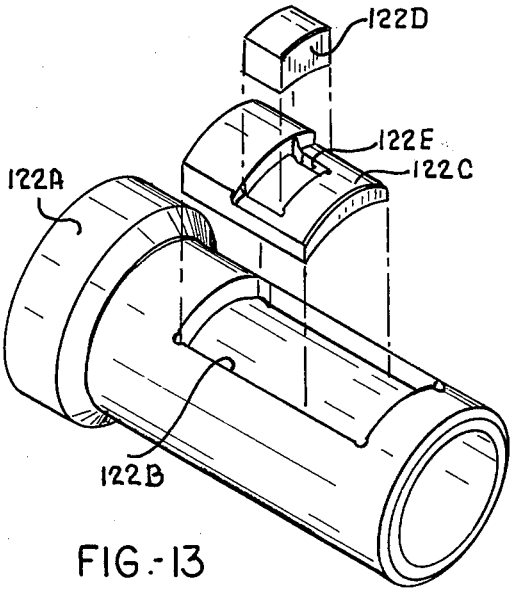
FIG. 13 is an exploded view in perspective of the bumper, bushings, and lugs of the equalizing valve and shock absorber.

With the exception of a few parts, the parts of the device 41A are either identical or substantially identical to the parts of the device 41 as previously described. Those identical parts will be identified by the same previously used reference numerals, while those which are substantially identical will be identified by the same reference numerals with the postscript "A" added. Referring to FIG. 12, the equalizing valve and shock absorber 41A is a telescoping device which, like the device 41, employs various relative longitudinal positions of the telescoping members to perform the equalizing valve and shock absorbing functions. The device 41A has an outer tubular body comprising the valve guide and manifold 72, the housing member 74, and the sleeve 71 threaded at an upper end along the lower end portion of the member 74. The upper end of the member 72 has the upwardlly opening blind bore 75 for communication from the upper end of the device into the radial ports 80 which open into the annular space 81 between the members 74 and the reduced outer wall portion of the member 72. As previously described, in connection with the device 41, the annular space 81 within the sleeve 84 extends within the member 74 below the lower end of the member 72 to allow upward flow around the member 72 in the annular space 81 to the radial ports 80. The member 72 and the sleeve 74 are welded together and provided with the bleed port 92 into the bore 90 to permit valve action to occur without trapping fluid which would impede the telescoping action of the members of the device. A ring seal 102 is supported within the lower end portion member 72 forming a fluid tight seal with the upper end portion of the valve and mandrel member 104A so that upward fluid flow along the valve member within the housing sleeve portion 74 is diverted to the annular passage 81 which communicates with the radial ports 80 leading into the central upper end bore 75. The valve and mandrel member 104A telescopes into the housing sleeve 74 serving both a valve function and transmitting longitudinal forces during the shock absorbing function of the device 41A. The upper end portion of the member 104A slides within the bore portion 90 of the member 72. The side port 92 permits any fluid trapped within the bore 90 above the valve member to escape thereby not interfering with the operation of the valve member. The valve and mandrel member 104A has radial slots 112 opening through the wall of the member from the central bore 111 of the member. When the valve member is at the open position of FIG. 12, bypass fluid flows from the central bore 111 outwardly through the ports 112 escaping from the device 41A through the side port 123 in the housing sleeve 71. The split-ring type upper spring stop 121 is fitted around the valve and mandrel member 104A below the longitudinal ports 112. The upper end of the spring 120A engages the lower face of the spring stop 121. The lower end of the spring 120A engages the upper end face of a tubular shaped bumper 122A which fits in sliding relationship around the member 104A and has an enlarged head end portion engageable with an internal flange 71A formed within the lower portion of the housing sleeve 71 limiting the downward movement of the bumper within the housing. The bumper extends below the lower end of the housing sleeve 71 for engagement with the coupling 130 when serving a shock absorbing function. As shown in FIG. 13, the bumper 122A has oppositely disposed longitudinal windows 122B. A lug bushing 122C is positioned in each window 122B. A latch lug 122D is positioned for radial movement in a window 122E in each of the lug bushings. The inward portions of each of the latch lugs is engageable in an external annular latch recess 104B formed in the valve and mandrel member 104A. The outer portion of each of the latch lugs is engageable in an internal latch recess 71A within the lower end of the housing sleeve 71. The longitudinal windows 122B of the bumper are longer than the lug bushings 122C to permit the bumper to move longitudinally independently of the lug bushings and the latch lugs allowing the shock absorber action of the spring 120A without moving the lugs and lug bushings. The latch lugs permit the valve and shock absorber member 104A to be locked at an intermediate longitudinal position at which the equalizing valve ports 112 are partially opened when running a tool string including the equalizing valve and shock absorber device 41A into a well bore. The locking recess 104B in the valve and mandrel member 104A has an upwardly and outwardly tapered upper end cam surface for expanding the latch lugs 122D to release the latch lugs from the latched positions of FIG. 12 after the tool string has been run and the equalizing valve is closed.

The spring 120A serves a duel function of a shock absorbing spring and a return spring for biasing the equalizing valve closed by applying a longitudinal force between the valve and mandrel member 104A and the housing sleeve 71 tending to telescope the housing downwardly on the member 104A.

In the operation of the equalizing valve and shock absorber 41A, the device is connected in a tool string in the same manner as the equalizing valve and shock absorber 41 preliminary to running the tool string in a well bore. The valve and mandrel member 104A of the device 41 is adjusted to the running position at which the equalizing valve is partially open as represented in FIG. 12. By manipulating the longitudinal position of the member 104A within the housing of the device, the latch lugs 122D are aligned with the locking recess 104B around the member 104A and the locking recess 71B within the housing sleeve 71. A tool such as a screwdriver is then inserted through the holes 71C in the housing sleeve 71 forcing the lugs 122D inwardly until the inner portions of the lugs engage the locking recess 104B of the member 104A locking the device in the running condition. The spring 120A is sufficiently compressed to urge the member 104A and the housing sleeve 71 in opposite directions with enough force to hold the lugs 104B in the inward latched positions. The lower end face of the locking recess 104B is an abrupt stop shoulder which will not cam the latch lugs outwardly and thus they remain locked until the housing sleeve is lifted for releasing the lugs. With the device 41A latched in the running, partially open condition of FIG. 12, the tool string is lowered in the well bore with well fluids flowing upwardlly through the tool string into the central bore 111 of the valve and mandrel member 104A. Fluids in the central bore 111 flow outwardly through the ports 112 and downwardly into the housing sleeve 71 above the upper spring stop 121. The fluids then exit from the housing sleeve through the side ports 123. Fluids may also flow upwardly around the valve and mandrel member into the anulus 81, through the ports 80, and upwardly from the device in the bore 75. With the fluids readily bypassing through the device 41A the tool string may be lowered easily in a liquid filled hole.

With the tool train landed and locked in the well bore as previously described, the equalizing valve and shock absorber 41A is released from the latched condition of FIG. 12 preliminary to fully closing the equalizing valve so that fluid communication may be directed upwardly only through the device 41A to the bore 75 at the upper end of the device rather than through the equalizing valve portion. An upward force is applied to the tool train lifting the head 72 and the housing 70 upwardly relative to the valve and mandrel member 104A which is held against upward movement by the connection of the locking probe into the lock mandrel 32 as represented in FIG. 1 and FIG. 2D. The lower end of spring 120A urges the bumper 122A downwardly applying a downward force through the lug bushings 122C to the lugs 122D which engage the bottom of the latch recess 71B of the sleeve 71. The upward movement of the housing 70 including the sleeve 71 lifts the lugs 122D, the bushngs 122C and the bumper 122A relative to the mandrel 104A so that the latch lugs are cammed outwardly by the cam surface at the upper end of the latch recess 104B in the outer surface of the valve and mandrel member 104A. When the latch lugs are cammed fully outwardly from the recess 104B, the housing is released telescoping upwardly on the member 104A compressing the spring 120A to the position shown in FIG. 14 at which the bypass valve portion of the device is fully opened and the spring is fully compressed. The lifting force is then released allowing the spring 120A to expand applying the downward force of the expanding spring to the weight of the tools above the device 41A so that the housing 70 along with the bumper 122A, the latch lugs 122D, and the latch lug bushng 122C telescope downwardly to the positions illustrated in FIG. 15. The housing 70 moves downwardly over the upper end of the valve and mandrel member 104A to the position shown in FIG. 15 at which the ring seals 115 carried by the housing are positioned below the ports 112 isolating the ports from the bypass side ports 123 while communicating the ports 112 along the upper portion of the valve member with the annular space 81 leading to the radial passages 80 which connect with the upper central bore 75 of the valve so that the bypass valve is closed and communication is established with the central bore at the upper end of the device. It will be recognized that in shifting the parts of the device between the released fully open position of FIG. 14 and the closed condition of FIG. 15, the lugs 122D move downwardly with the housing sleeve from above the locking recess 104B to a position below the locking recess. The lugs do not move back inwardly into the locking recess 104B because the lugs are wedged between the upper ends of the windows 122E of the lug bushings and the lower end of the latch recess 71B in the sleeve 71. Once the device is released from the latched running position of FIG. 12, the lugs 122D cannot be relatched. The only way the equalizing valve and shock absorber can be reset by relatching the lugs is to remove the device to the surface where a tool inserted through the reset holes 71C is used to relatch the lugs.

Figure 14:
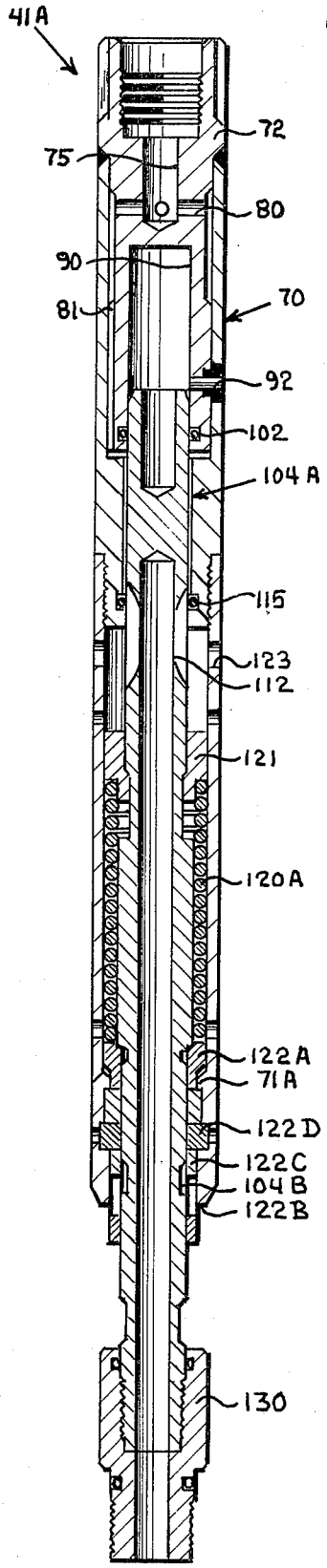
FIG. 14 is a longitudinal view in section of the equalizing valve and shock absorber telescopically extended with the valve fully open.
Figure 15:
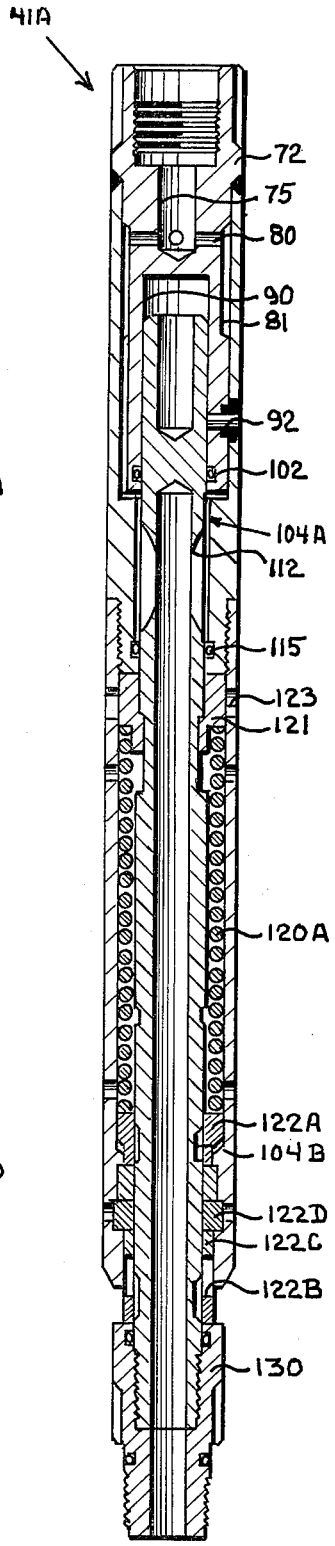
FIG. 15 is a longitudinal view in section of the equalizing valve and shock absorber telescoped to a valve closed condition.

If for any reason it is desired to reopen the bypass valve, an upward force is applied to the tool string above the device 41A lifting the housing 70 back upwardly to the position of FIG. 14 at which the ports 112 communicate with the equalizing valve side ports 123. The spring 120A is compressed so that when the lifting force is released the spring expands moving the housing back downwardly to the position of FIG. 15 reclosing the equalizing valve portion of the device. Since the spring 120A exerts a downwardly closing force it is possible to open and reclose the equalizing valve even in the presence of upwardly flowing liquid in the bore hole.

Figure 16:
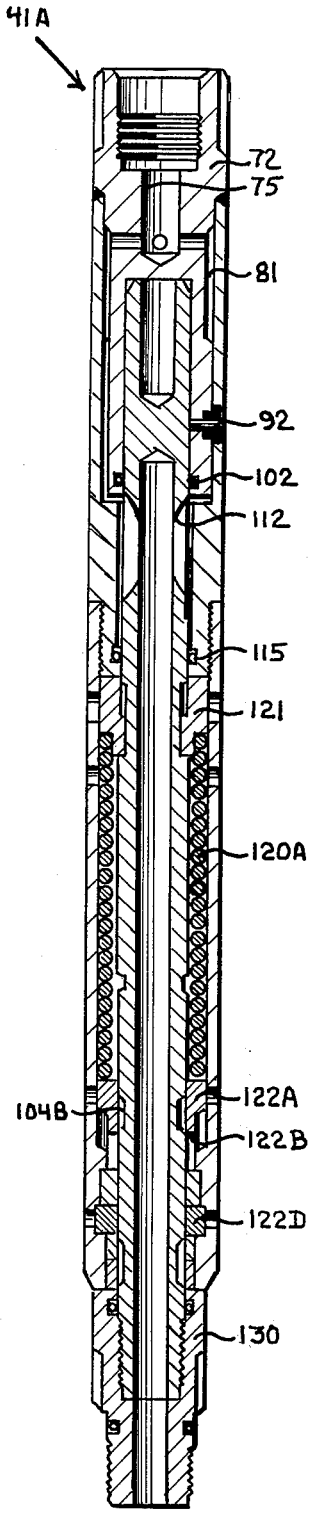
FIG. 16 is a longitudinal view in section of the equalizing valve and shock absorber telescoped to a minimum length for maximum shock absorbing function.

FIG. 16 illustrates the condition of the device 41A when operating in a shock absorbing mode such as when the tool train is being pulled from a well bore and the latching system suddenly releases allowing recoil action to snap the tool train upwardly. The entire housing together with the upper spring retainer 121, the lugs 122D, and the lug bushings 122C may remain longitudinally fixed. The valve and mandrel member 104A moves upwardly to the upper end position shown in FIG. 16. As the valve and mandrel member move upwardly the upper end of the coupling 130 engages the lower end edge of the bumper 122A forcing the bumper upwardly lifting the lower end of the spring 120A compressing the spring until the various parts are at the positions illustrated in FIG. 16. The fact that the windows 122B of the bumper are substantially longer than the latch lug bushings 122C permits the bumper to move upwardly to compress the spring while the latch lugs and bushings remain longitudinally fixed because the lugs engage the housing recess 71B. Thus, the upward force of the coupling 130 is applied through the bumper to the compressing spring so that the spring absorbs the shock to protect tools such as measuring instruments connected in the tool string above the equalizing valve and shock absorber.

While the system including the gauge 34 have been described in terms of pressure measurement, it will be recognized that such other well operating conditions may be measured as fluid flow rate by using a gauge which allows fluid flow back into the tubing string 30 above the gauge and on to the surface in the tubing string.

A further form of equalizing valve and shock absorber 41B embodying the features of the invention is illustrated in FIGS. 17–21 inclusive. The device 41B performs the same equalizing valve and shock absorbing functions as the previously described devices 41 and 41A. The device 41B is spring biased open so that when it is run into a well bore in a tool string the valve structure of the device remains open until the tool string is landed and locked in the well bore as previously discussed. The structure of the device 41B insures that as the locking probe 43 is stabbed into the locking sub 33, the equalizing valve will remain open. The valve is closed by lifting the tool string for taking pressure measurements and the like and returns to the open position as the lifting force is relaxed so that the spring of the device along with the weight of the tools above it returns the housing downwardly over the valve member reopening the equalizing valve. As in the case of the other forms of the device 41 and 41A, shock may be absorbed during both the installation of the tool string and the retrieval of the string. Impact forces both downwardly and upwardly are absorbed by the shock absorbing spring of the device.

Figure 17:
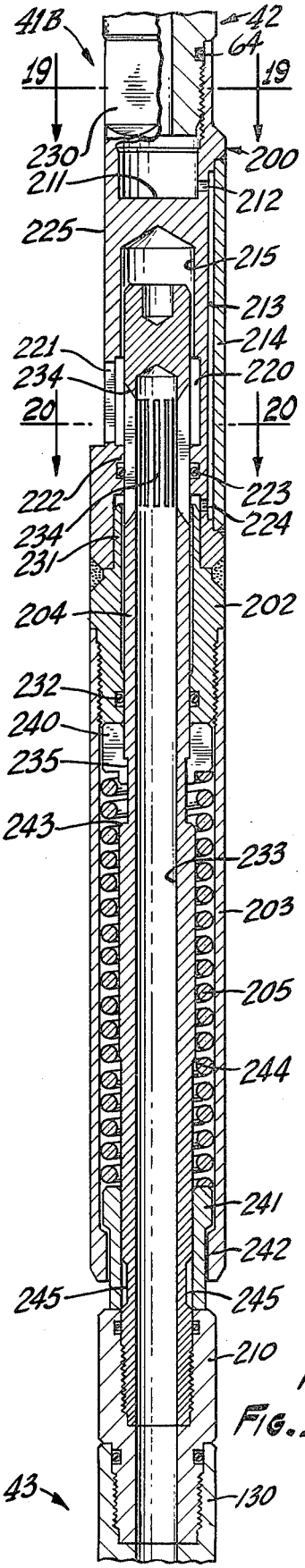
FIG. 17 is a fragmentary longitudinal view in section of a further form of equalizing valve and shock absorber in accordance with the invention, showing the valve open.

Referring specifically to FIG. 17 which shows the equalizing valve and shock absorber 41B in the open position, the device has a crossover head 200, a housing coupling section 202, and a shock absorber spring skirt 203. The head and housing members of the device fit telescopically over and are longitudinally movable on an equalizing valve and mandrel 204. The valve and mandrel and the head and housing of the device are coupled together and spring biased by a spring 205 which also functions as a shock absorber. The spring urges the head, housing, and spring skirt telescopically downwardly on the valve and mandrel member toward the valve open position shown in FIG. 17. The head, housing and skirt may be lifted against the spring on the valve and mandrel member to the valve closed position illustrated in FIG. 18. The upper end of the crossover head 200 is threaded on the lower pin portion of the tool string coupling 42. The ring seal 64 carried by the coupling seals between the coupling and the crossover head. The lower end of the valve and mandrel member 204 threads into a coupling 210 secured in the upper end section 130 of the probe 43.

Referring to FIG. 17, the crossover head 200 has an upwardly opening blind bore 211 which opens into the bore 60 in the coupling 42 for communicating fluid pressure and temperature measurements to instrumentation connected with the tool string as previously discussed. A lateral port 212 opens from the lower end of the bore 211 into a longitudinal slot 213 which is milled along substantially the full length of the crossover head and closed by a longitudinal plate 214 welded to the head. The longitudinal slot 213 is a graduated or stepped slot along the outer wall of the crossover head shaped to receive the closure plate 201 so that the outer portion of the slot is closed leaving the inner longitudinal portion open for communication along the crossover head from the equalizing valve 204 into the bore 211. The crossover head has a downwardly opening blind bore 215 into which the upper end portion of the equalizing valve 202 telescopes. The bore 215 is enlarged along a central section 220 providing an annular flow space within the crossover head around the upper portion of the equalizing valve. Three circumferentially spaced windows 221 are formed in the crossover head opening into the flow space 220 providing substantial flow communication from the bore of the crossover head outwardly around the head for rapid pressure equalization into the well bore when the valve is open. The bore 215 of the crossover head is reduced in diameter along a section below the flow space 220 defining an internal annular flange 222 having an annular recess in which a ring seal 223 is disposed for sealing engagement with the outer surface of the equalizing valve 204. The crossover head has a lateral port 224 which opens between the longitudinal flow channel 213 and the crossover head bore 215 below the internal flange 222 and ring seal 223 allowing flow communication from the crossover head bore 215 around the valve 204 along the channel 213 into the crossover head bore 211. Referring to both FIGS. 17 and 18, the crossover head 200 has three longitudinal flat outside faces 225 circumferentially spaced around the head above the flow windows 221. The upper end portion of the crossover head is provided with three circumferentially spaced wrench flats 230 alternately spaced between the flats 225 above the windows 221 for engagement of a tool used in assemblying and disassemblying the equalizing valve and shock absorber. The reduction in the cross section of the crossover head effected by the flats 225 and 230 minimizes any tendency of high upward fluid flow rates through the windows 221 to lift the device possibly pulling the tool train upwardly disengaging the probe from the locking sub. At all flow rates tested with prototype tools the flats on the crossover head eliminated lifting of the tool train by upward fluid flow.

Figure 18:
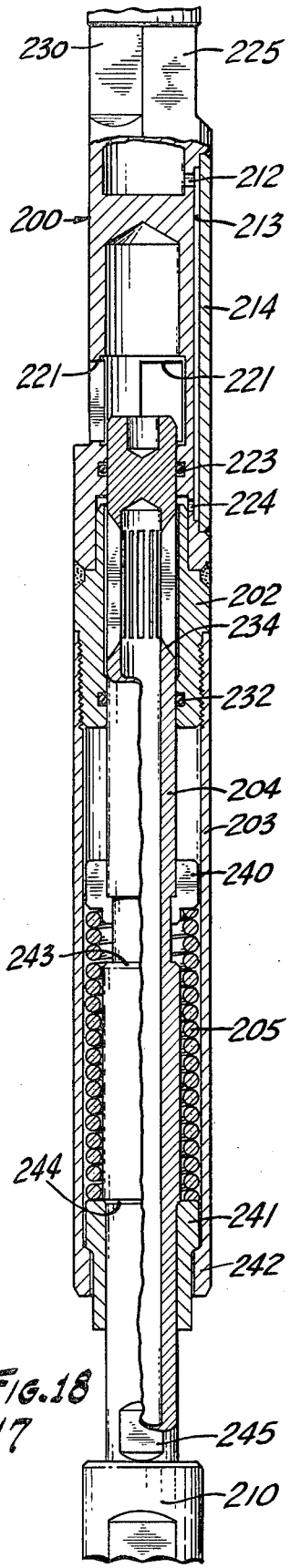
FIG. 18 is a fragmentary longitudinal view in section of the valve and shock absorber of FIG. 17, showing the valve closed.
Figure 19:
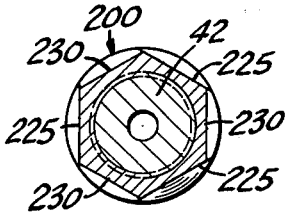
FIG. 19 is a view in section along the line 19—19 of FIG. 19.
Figure 20:
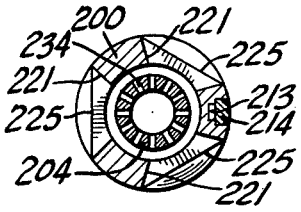
FIG. 20 is a view in section along the line 20—20 of FIG. 10.

As shown in FIGS. 17 and 18, the housing coupling 202 is welded with the lower end of the crossover head 200. The coupling has a reduced upper end portion 231 which fits within an enlarged lower end portion of the crossover head bore 215 around the equalizing valve 204. The lower portion of the coupling 202 has an internal annular flange portion provided with an internal annular recess in which a ring seal 232 is fitted forming a seal with the outer surface of the equalizing valve 204. The bore through the coupling 202 above the internal flange portion of the coupling and the upper end portion of the bore 215 of the crossover head are larger than the equalizing valve 204 providing annular flow space within the coupling above the ring seal 232 and within the crossover head around the equalizing valve. The flow space within the bore 215 of the crossover head around the upper end portion of the equalizing valve prevents fluid entrapment which would impair the upward and downward movement of the equalizing valve in the crossover head. The flow space around the equalizing valve within the coupling 202 permits continuous communication into the side port 224 at the lower end of the crossover head leading to the longitudinal flow channel 213 for continuous fluid communication from the bore of the equalizing valve into the head end of the equalizing valve and shock absorber device.

The equalizing valve and mandrel member 204 has a downwardly opening blind bore 233 which terminates at an upper end within the upper end portion of the valve and mandrel member. The valve and mandrel member has a plurality of circumferentially spaced longitudinal slots 234 which communicate the bore of the valve and mandrel member with the flow space 220 when the valve is open as shown in FIG. 17 for pressure equalization between the valve bore to the space around the device through the windows 221. The flow slots 234 are positioned between the upper ring seal 223 and the lower ring seal 232 within the crossover head 200 and the coupling 202 when the valve is closed as shown in FIG. 18 preventing fluid communication from the bore of the valve through the crossover head windows 221.

As illustrated in FIGS. 17 and 18, the valve and mandrel member 204 is reduced along a central portion providing an external annular recess 235 for a split ring spring stop 240 engaged by the upper end of the valve and shock absorber spring 205. The recess 235 in the valve member is longer than the flange portions of the split ring permitting limited longitudinal movement of the split ring on the valve and mandrel member. The upper end edge of the split ring engages the lower end edge of the housing coupling 202. The lower end of the spring 205 engages the upper end edge of a spring stop or bumper 241 which has an externally flanged upper end portion held within the spring skirt 203 by an internally flanged lower end portion 242 of the skirt. The spring stop 241 is of sufficient length to extend beyond the lower end of the skirt 203 so that the lower end edge of the bumper 241 is engageable with the upper end edge of the coupling 210 holding the lower end edge of the spring skirt 203 spaced from the upper end edge of the coupling as shown in FIG. 17. The valve and mandrel mamber 204 has an upwardly facing external annular stop shoulder 243 at the lower end of the external annular recess 235 limiting the downward movement of the split ring spring stop 240 on the valve and mandrel member. Similarly the valve and mandrel member has a downwardly facing external annular stop shoulder 244 which limits the upward movement of the spring stop or bumber 241. The spring 205 is compressed between the split ring 240 and the spring stop 241 so that when the split ring 240 and the spring stop 241 are at opposite end positions, the spring still exerts sufficient force to hold the valve and mandrel member 204 at the upper open position even when those portions of the tool string shown in FIG. 1 below the device 41B are connected with the device so that as the tool string is run into a well bore the equalizing valve remains open. The valve and mandrel member 205 has flat surfaces 245 on opposite sides of the member for engagement of the wrench used for assemblying and disassemblying the device.

In operation the equalizing valve and shock absorber **41*b* is connected in a tool string as illustrated in FIG. 1 to permit pressure equalization along the well bore as the tool string is installed and retrieved and to provide a shock absorbing function for protection of the instrumentation during the handling of the tool string. With the device connected in the tool string and the tool string being lowered in the well bore, the strength of the spring 205 is sufficient to hold the valve and mandrel member 204 at the upper open position of FIG. 17 as the tool string is lowered in the well bore. The spring 205 is confined between the split ring 240 at the upper end and the spring stop 241 at the lower end. The upper end of the spring supports the split ring 240 which is fitted around the valve and mandrel member 204 holding the member at the upper end position shown in FIG. 17 supporting the adjustable probe 43 which hangs from the device 41*b*. As the tool string including the equalizing valve and shock absorber is lowered in the well bore, fluid passing upwardly through the bore 233 of the valve and mandrel member passes outwardly through the flow slots 234 into the flow space 220 within the crossover head 200. The fluid exits from the crossover head through the radial windows 221 back into the well bore thereby preventing a pressure differential from building between the well bore and the bore through the tool string which would impede the lowering of the tool string. As the locking probe is stabbed into the locking sub 33, the upward reaction force of the locking sub on the probe applies an upward force on the valve and mandrel member 204 which together with the force of the spring 205** insures that the equalizing valve remains open. This is important at this point in the handling of the tool string because in a liquid filled well bore the stabbing of the locking probe into the restricted passage through the locking sub may develop a pressure differential which would interfere with the insertion of the locking probe in the absence of the equalizing valve function.

As the locking probe is stabbed into the locking sub shock forces are absorbed by the shock absorber spring 205 protecting the instrumentation in the tool string above the device 41*b*. Such a shock force may develop from sudden stopping of the downward movement of the probe which means that the valve and mandrel member 205 which is directly coupled into the coupling 210 stops moving downwardly while the crossover head 200 along with the housing formed by the coupling 202 and the shock absorber spring skirt 203 telescope downwardly over the valve and mandrel member until the lower end edge of the lower end portion 242 of the skirt 203 engages the upper end edge of the coupling 210. The lower end edge of the coupling 202 forces the split ring 240 downwardly on the member 204 compressing the spring 205. The lower end of the spring 205 cannot move downwardly because of engagement with the upper end of the spring stop 241 which rests on the coupling 210. The compression of the spring absorbs the shock force.

After the tool train including the equalizing valve and shock absorber 41B is properly landed and locked in the well bore, the desired measurements previously discussed may be taken by closing the bypass valve so that the various operating conditions are communicated through the valve to the instrumentation. It will be recognized that pressure from below the equalizing valve is transmitted at all times to the tools above the valve whether the equalizing valve is open or closed. With the equalizing valve open providing substantial outlets into the well bore around the tool, the desired measurements of the tool will not be accurately reflected. Referring to FIG. 17 showing the equalizing valve open, there is communication to the upper end of the device 41B from the bore 233 through the valve and mandrel member 204 outwardly through the side port 224 below the ring seal 223 into the longitudinal channel 213. The pressure from the channel 213 is communicated into the lower end of the bore 211 of the device through which the pressure is transmitted to the tools and instrumentation above the device. The equalizing valve is closed as illustrated in FIG. 18 by lifting the tool string above the device 41B upwardly thereby raising the crossover head 200, the coupling tool 2, and the spring skirt 203. Thus the housing of the device is telescoped upwardly relative to the equalizing valve and mandrel member 204 which is held against upward movement since it is connected into the coupling 210 which connects with the locking probe previously latched into the locking sub as discussed above. The upward movement of the housing device positions the spaced ring seals 223 and 232 above and below the flow slots 234 of the valve member 204 so that fluid flow may not occur outwardly into the windows 221 of the crossover head. Flow is thus limited to the annular space around the valve and mandrel member 204 within the housing coupling 202 so that the fluid communication is restricted to the side port 224 upwardly through the flow channel 213 into the lower end of the bore 211 of the crossover head along which fluid pressure is communicated to the instruments above the equalizing valve and shock absorber 41B.

The equalizing valve and shock absorber may be returned from the equalizing valve closed position of FIG. 18 to the open position of FIG. 17 for pressure equalizing and for flow rate tests which may be conducted in the tubing above the tool string. The equalizing valve is reopened by slacking off on the tension placed on the tool string so that the weight of the tool string above the device 41B together with the force of the compressed spring 205 returns the crossover head and housing downwardly to the position of FIG. 17. Any shock forces which may occur when the equalizing valve is reopened is absorbed by the spring 205. The downward movement of the crossover head and housing telescopes the head and housing downwardly on the valve and mandrel member 204 causing the split ring 240 to move downwardly against the upper end spring and the spring stop 241 to remain fixed holding the lower end of the spring as the spring is depressed and the skirt 203 telescopes downwardly until the lower end of the skirt engages the upper end of the coupling 210. Of course, after the shock has been absorbed by the spring 205 the spring normally will extend returning the valve part to the valve open position of FIG. 17.

The tool train including the device 41B is retrieved from a well bore in the manner previously discussed. Any shock forces in the tool train as a reaction to pulling the probe from the locking sub will be absorbed by the spring 205 as the lower portion of the train including the locking probe snap upwardly telescoping the valve mandrel member 204 upwardly relative to the crossover head and housing compressing the spring 205 to absorb the reaction shock protecting the instruments.

Figure 21:
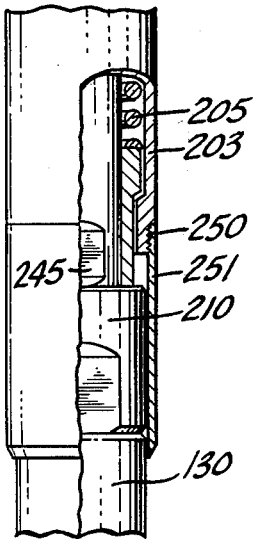
FIG. 21 is a fragmentary view in section and elevation of the lower end of a modified form of the valve and shock absorber of FIGS. 17 and 18.

In the event that debris in a well bore might tend to foul the device 41B by getting into the spring skirt 203 a modified form of the lower end of the device may be provided as shown in FIG. 21. Referring to FIG. 21, the lower end of the skirt 203 is threaded at 250 for engagement of a skirt extension 251 on the lower end of the skirt. The skirt extension 251 telescopes downwardly over the coupling 210 and is of sufficient length to overlap the connection of the valve and mandrel member 204 into the coupling 210 when the valve is closed as shown in FIG. 18. Thus, the skirt extension 251 forms a close sliding fit over the coupling 210 and the portion 130 of the probe when the valve is open and when the valve is closed minimizing the possibility of debris getting into the interior of the skirt 203 around the spring 205. FIG. 21 represents the valve in the open condition of FIG. 17. When the valve is closed as in FIG. 18, the skirt 251 will overlap the upper end of the coupling 210.

It will now be seen that a system of well tools has been described and illustrated which may be readily installed in existing wells for measuring well characteristics. The system includes a new and improved equalizing valve and shock absorber operable responsive only to longitudinal telescoping action for both equalizing pressure across a seal established by the tool string in the well bore and for absorbing shock encountered during the installation and retrieval of the tool string to protect the measuring equipment included in the string.

I claim:

1. An equalizing valve for use in a tool string in a well bore comprising: an outer tubular housing having a head end provided with fluid flow passages for communicating with a well tool connected with said housing; a longitudinally movable valve-mandrel member supported in said housing having a longitudinal bore open at an end opposite to said head end of said housing and having radially opening ports communicating with the other end of said bore through said valve-mandrel member, said valve-mandrel member being movable from a first closed position to a second open position; spaced seal means between said housing and said valve-mandrel member positioned on opposite sides of said radially opening ports in said member when said member is at said first closed position; said housing being provided with a side port communicating with said radial ports of said valve-mandrel member when said member is at said second open position; said housing having flow passage means communicating with said passage means in said head end of said housing for fluid communication from said bore to said valve-mandrel member and said head end passages when said valve member is at said first position; and spring means engaged between said housing and said valve-mandrel member biasing said housing and said valve-mandrel in opposite longitudinal directions; and said valve-mandrel member and said housing being connected to move in telescopic relationship whereby oppositely directioned forces applied to said housing and to said valve-mandrel member move said valve-mandrel member between said first closed position and said second open position.

2. An equalizing valve in accordance with claim 1 wherein said spring means between said housing and said valve-mandrel member biases said housing and said valve-mandrel member toward said second open position.

3. An equalizing valve in accordance with claim 1 wherein said spring means between said housing and said valve-mandrel member biases said housing and said valve-mandrel member toward said first closed position.

4. The apparatus of claim 1 including shock absorber means comprising a shock absorbing spring disposed between said housing and said valve-mandrel member; a first spring stop member between said housing and said valve-mandrel member and engageable with one end of said spring, said first stop member being movable longitudinally relative to both said valve-mandrel member and said housing and being engageable with a stop shoulder on said valve-mandrel member and a stop shoulder in said housing; and a second spring stop member between said valve-mandrel member and said housing and engageable with the second opposite end of said spring, said second stop member being movable longitudinally relative to said valve-mandrel member in said housing and being engageable with stop shoulders on said valve-member and within said housing; said spring being compressible responsive to relative movement of either of said valve-mandrel and said housing respective to the other for absorbing impact forces to minimize the effect of such forces on said apparatus.

5. The apparatus of claim 4 wherein said spring means between said housing and said valve-mandrel member biases said housing and said valve-mandrel member toward said second open position.

6. An equalizing valve and shock absorber device in accordance with claim 5 wherein said head end includes circumferentially spaced lateral windows communicating with said radial ports of said valve-mandrel member when said member is at said second open position.

7. A device in accordance with claim 6 wherein said head end has circumferentially spaced longitudinal flat surfaces above said lateral windows providing a cross section of less area above said windows than below said windows to minimize any lifting effect of fluid flow through said windows on said device.

8. The apparatus of claim 4 wherein said spring means between said housing and said valve-mandrel member and said shock absorbing spring comprise a single spring biasing said housing and said valve-mandrel member toward said first closed position.

9. The apparatus of claim 8 wherein said second spring stop member comprises a tubular bumper having oppositely disposed longitudinal windows; a latch lug bushing in each of said windows, said bushing being shorter in length than the length of said window in said bumper, said bushing each having a window therein; and a latch lug disposed in said window of each of said bushings for radial movement between inner latching positions and outer release positions, and said valve-mandrel member having an external annular locking recess alignable with said latch lugs at a valve open running position at which said latch lugs are positioned inwardly engaging said locking recess for releasably holding said device in said running condition, said locking recess of said valve-mandrel member having one end cam surface for expanding said latch lugs to release positions upon relative movement between said housing and said valve-mandrel member.

10. An equalizing valve and shock absorber device for use in a tool string in a well bore comprising: an outer tubular housing having a head end provided with fluid flow passages for communicating with a well tool connected with said housing; a longitudinally movable valve-mandrel member supported in said housing having a longitudinal bore open at an end opposite to said head end of said housing and having radially opening ports communicating with the other end of said bore through said valve-mandrel member, said valve-mandrel member being longitudinally movable in telescopic relationship with said housing between a first retracted closed position and a second extended open position; spaced seal means between said housing and said valve-mandrel member on opposite sides of said radial ports in said valve-mandrel member when said valve-mandrel member is at said first closed position; said housing being provided with a side port communicating with said radial ports of said valve-mandrel member when said valve-mandrel member is at said second open position; said housing having flow passage means communicating with said passage means in said head end of said housing for fluid communication from said bore of said valve-mandrel member to said head end passages when said valve-mandrel member is at said first closed position; a valve spring engaged between said housing and said valve-mandrel member biasing said valve-mandrel member and said housing in opposite longitudinal directions from said first retracted closed position to said second extended open position; a shock absorber spring disposed between said housing and said valve-mandrel member; a first spring stop between said housing and said valve-mandrel member engageable with one end of said spring and movable longitudinally relative to both said valve-mandrel member and said housing and being engageable with a stop shoulder on said valve-mandrel member and a stop shoulder in said housing; and a second spring stop member between said valve-mandrel member in said housing and engageable with the second opposite end of said shock absorber spring, said second stop member being movable longitudinally relative to said valve-mandrel member is said housing and being engageable with stop shoulders on said valve-mandrel member and within said housing, said shock absorber spring being compressible responsive to relative movement of either of said valve-mandrel member and said housing respective to the other for absorbing impact forces to minimize the effect of such forces on said apparatus.

11. An equalizing valve and shock absorber device for use in a tool string in a well bore comprising: an outer tubular housing having a head end provided with fluid flow passages for communicating with a well tool connected with said head end of said housing; a longitudinally movable valve-mandrel member supported in said housing having a longitudinal bore open at an end opposite from said head end of said housing and having radially opening ports communicating with the other end of said bore through said valve-mandrel member, said valve-mandrel member being telescopically movable in said housing between a first retracted closed position to a second extended open position; spaced seal means between said housing and said valve-mandrel member positioned on opposite sides of said radially opening ports in said valve-mandrel member when said valve-mandrel member is at said first retracted closed position; said housing being provided with a side port communicating with said radial ports of said valve-mandrel member when said valve-mandrel member is at said second extended open position; said housing having fluid flow passage means communicating with said passage means in said head end of said housing for fluid communication from said bore of said valve-mandrel member and said head end passages when said valve-mandrel member is at said first closed position; a valve and shock absorbing spring disposed between said housing and said valve-mandrel member for biasing said valve-mandrel member and said housing together in longitudinal directions toward said retracted first closed position; a first spring stop between said valve-mandrel member and said housing engaged with a first end of said spring toward said radial ports in said valve-mandrel member, said first spring stop being longitudinally movable between spaced stop shoulders on said valve-mandrel member and engageable with an internal stop shoulder in said housing; a tubular bumper around said valve-mandrel member within said housing engageable at one end with the opposite end of said spring and having an external annular stop shoulder engageable with an internal annular stop shoulder within said housing, said bumper having oppositely disposed longitudinal windows; a lug bushing in each of said windows of said bumper between said valve-mandrel member in said housing, each of said lug bushings having a window therein; and a latch lug in each of said windows of each of said lug bushings radially movable between an inward position at which said latch lugs engage a locking recess around said valve-mandrel member for releasably locking said valve-mandrel member at a partially open running position in said housing and said latch lugs being expandible to disengage from said locking recess of said valve-mandrel member at which said valve-mandrel member is released for movement between said first closed position and said second open position, one end of said bumper extending from an end of said housing and said longitudinal windows of said bumper being longer than said lug bushings to permit longitudinal movement of said bumper relative to said latch lugs, said latch bushings, said valve-mandrel member and said housing for applying a shock force through said bumper to said spring to absorb shock forces in said tool string when said valve-mandrel member and said housing are telescoped together by impact loads applied to said device.

12. An equalizing valve and shock absorber for use in a tool string in a well bore comprising: a crossover head having connection means at a first end for securing said first end with a supporting tubular member, a first blind bore opening through said first end, a second blind bore opening through a second end of said crossover head, said first and second blind bores being aligned along a common longitudinal axis of said head, a longitudinal flow channel extending along and spaced from said first and second blind bores, a first lateral port opening between said first blind bore and said flow channel, a second lateral port longitudinally spaced from said first port and opening into said second blind bore spaced from the inward end of said second blind bore, lateral circumferentially spaced flow windows opening into said second blind bore between said inward end of said blind bore and said second lateral port, a ring seal around said second blind bore between said second lateral port and said windows; a housing section secured with the second end of said crossover head having a longitudinal bore along an axis coincident with the axis of said bores in said crossover head, a ring seal around said bore of said housing section spaced from said ring seal in said crossover head, said bore of said housing section being larger along a central portion than said bores of said crossover head and said housing section on opposite sides of said ring seal in said crossover head and said ring seal in said housing section; a shock absorber skirt secured with said housing section on the end of said section opposite said crossover head along an axis coincident with the longitudinal axis of said crossover head and said housing section, said skirt having an internal annular stop flange at a second end of said skirt opposite the end connected with said housing section; an elongated equalizing valve and mandrel telescopically positioned for longitudinal movement within said crossover head, said housing section, and said skirt, said equalizing valve and mandrel having a blind bore terminating at a first end extending into said crossover head and opening through the opposite second end of said equalizing valve and mandrel, a plurality of longitudinal circumferentially spaced flow slots opening through said valve and mandrel into said bore of said valve and mandrel at the inward end of said bore positioned to align with said windows in said crossover head at a first valve open position of said valve and mandrel and to be located between said ring seals in said crossover head and said housing section at a second valve closed position of said valve and mandrel, said valve and mandrel along an upper portion thereof including said flow slots being smaller in diameter than said bores through said crossover head and said housing section to permit fluid flow from said bore of said valve and mandrel along said valve and mandrel within said crossover head and said housing section to said second lateral port in said crossover head at all longitudinal positions of said valve and mandrel within said crossover head and housing section, an external annular locking recess around a central portion of said valve and mandrel, an external annular stop shoulder on said valve and mandrel spaced toward said second end of said valve and mandrel from said locking recess; a split ring spring stop in said external annular recess of said valve and mandrel engageable at a first end with an end edge of said housing section and providing a spring stop shoulder at a second end thereof, said split ring being movable longitudinally along said valve and mandrel in said locking recess; a second spring stop around said valve and mandrel spaced from said first spring stop within said skirt, said second spring stop having an external annular stop flange engageable with said stop flange in said skirt to retain said second spring stop in said skirt, said second spring stop extending beyond said stop flange of said skirt when said second spring stop external flange is engaged with said internal stop flange of said skirt; an equalizing valve bias and shock absorber spring within said skirt around said valve and mandrel engageable at a first end with said split ring spring stop and at a second opposite end with said second spring step, said spring being compressed between said spring stop to urge said valve and mandrel toward said first end position at which said flow slots in said valve and mandrel are aligned with said windows in said crossover head and said spring being compressible to permit said valve and mandrel member to move to a second opposite end position at which said flow slots in said valve and mandrel are aligned between said ring seal of said crossover head and said ring seal of said housing section precluding flow from said slots of said valve and mandrel to said windows of said crossover head; said second spring stop being engageable with said stop shoulder on said valve and mandrel member limiting movement of said valve and mandrel member to said second end position; said first and second spring stop being movable along said valve and mandrel to permit shock absorbing action by said spring upon movement of said valve and mandrel in either longitudinal direction; and said valve and mandrel extending at a second end from said second spring stop and provided with means for connection of said second end with an adjacent tubular member.

13. An equalizing valve and shock absorber in accordance with claim 12 wherein said crossover head has a plurality of circumferentially spaced longitudinal flat surfaces extending from said windows in said crossover head to the first end of said crossover head reducing the cross section of said crossover head between said windows and said first end to minimize the effect of fluid flow from said windows on said valve and shock absorber.

* * * * *